US012428917B2

(12) United States Patent
Dyck

(10) Patent No.: US 12,428,917 B2
(45) Date of Patent: Sep. 30, 2025

(54) DRILLING DOWNHOLE REGULATING DEVICES AND RELATED METHODS

(71) Applicant: DRILL SAFE SYSTEMS INC., Chestermere (CA)

(72) Inventor: David Dyck, Chestermere (CA)

(73) Assignee: DRILL SAFE SYSTEMS INC., Chestermere (CA)

( * ) Notice: Subject to any disclaimer, the term of this patent is extended or adjusted under 35 U.S.C. 154(b) by 0 days.

(21) Appl. No.: 17/962,315

(22) PCT Filed: Feb. 12, 2021

(86) PCT No.: PCT/CA2021/050158
§ 371 (c)(1),
(2) Date: Feb. 7, 2023

(87) PCT Pub. No.: WO2022/170414
PCT Pub. Date: Aug. 18, 2022

(65) Prior Publication Data

US 2024/0102347 A1 Mar. 28, 2024

(51) Int. Cl.
*E21B 17/07* (2006.01)

(52) U.S. Cl.
CPC ..... *E21B 17/076* (2013.01)

(58) Field of Classification Search
CPC ..... E21B 17/073
See application file for complete search history.

(56) References Cited

U.S. PATENT DOCUMENTS 1,342,955 A 6/1920 Gebhardt
1,655,817 A 1/1928 Marsh
1,777,156 A * 9/1930 Barnett ..... E21B 17/073 175/321

(Continued)

FOREIGN PATENT DOCUMENTS

AU 642438 B2 10/1993
CA 2421384 A1 9/2004

(Continued)

OTHER PUBLICATIONS

Sujan Reddy Gudigopuram, Experimental and CFD Simulation of a Helico-Axial Pump, Dissertation, available Dec. 2016, 165 pages.

(Continued)

*Primary Examiner* — Kipp C Wallace
(74) *Attorney, Agent, or Firm* — Robert A. Nissen

(57) ABSTRACT

A downhole regulating device used in a downhole drill string between a drilling rig and a drill bit. The downhole regulating device has a helical coupling between the upper and lower portion to allow a relative axial and rotational movement defined by the lead of the helical coupling, between the upper and lower portions; a bi-directional biasing device that resists movement in both extension and contraction from the neutral position depending on the combination of pumping pressure, torque, axial hanging loads from drill string components below the tool and applied weight on bit. The biasing device is designed such that there is no pre-load required. A secondary one-directional element may be part of the biasing device to modify the spring rate or stroke length in contraction direction. A metal and composite laminated torsion spring is also described.

24 Claims, 9 Drawing Sheets

(56) References Cited

U.S. PATENT DOCUMENTS 1,785,086 A * 12/1930 Hauk ..... E21B 17/073 464/21
2,066,505 A 1/1937 Arthur
2,104,339 A 1/1938 Armals
2,147,491 A 2/1939 Bus
2,197,539 A 4/1940 Hickman
2,240,519 A 5/1941 Reed
2,301,389 A 11/1942 Farris
2,346,602 A 4/1944 O'Bannon
2,372,461 A 3/1945 Uren
2,517,198 A 8/1950 Gilbert
2,528,448 A 10/1950 Munk
2,721,570 A 10/1955 Caparone
2,728,457 A 12/1955 Clarke
2,748,719 A 6/1956 Wells
2,754,086 A * 7/1956 Summers ..... E21B 44/005 175/322
2,891,569 A 6/1959 Goodner
2,969,742 A 1/1961 Arutunoff
2,991,635 A 7/1961 Warren
3,156,106 A 11/1964 Crane
3,175,501 A 3/1965 Carle
3,216,751 A 11/1965 Mott
3,291,057 A 12/1966 Carle
3,300,950 A 1/1967 Carle
3,323,326 A 6/1967 Vertson
3,339,380 A 9/1967 Fox
3,477,467 A 11/1969 Sewell
3,514,074 A 5/1970 Self
3,539,026 A 11/1970 Sutliff
3,624,822 A 11/1971 Carle
3,867,056 A 2/1975 Carle
3,871,193 A * 3/1975 Young ..... E21B 17/07 285/302
3,947,008 A 3/1976 Mullins
3,963,228 A 6/1976 Karle
3,998,443 A 12/1976 Webb
4,003,548 A 1/1977 Stradella
4,133,516 A 1/1979 Jurgens
4,186,569 A * 2/1980 Aumann ..... F16D 3/06 175/321
4,194,582 A 3/1980 Ostertag
4,231,767 A 11/1980 Acker
4,241,787 A 12/1980 Price
4,241,788 A 12/1980 Brennan
4,248,302 A 2/1981 Churchman
4,258,750 A 3/1981 Schnall
4,270,620 A 6/1981 Lawrence
4,274,433 A 6/1981 Schnall
4,276,904 A 7/1981 Jackson
4,276,947 A 7/1981 Hebel
4,279,274 A 7/1981 Seger
4,281,726 A 8/1981 Garrett
4,323,128 A 4/1982 Young
4,330,306 A 5/1982 Salant
4,336,918 A 6/1982 Karbo
4,386,653 A 6/1983 Drake
4,394,884 A 7/1983 Skipper
4,425,965 A 1/1984 Bayh
4,434,863 A 3/1984 Garrett
4,436,151 A 3/1984 Callihan
4,439,167 A 3/1984 Bishop
4,443,206 A 4/1984 Teng
4,450,912 A 5/1984 Callihan
4,466,496 A 8/1984 Jones
4,473,210 A 9/1984 Brighton
4,481,020 A 11/1984 Lee
4,510,993 A 4/1985 Luetzelschwab
4,515,608 A 5/1985 Clegg
4,518,888 A 5/1985 Zabcik
4,541,454 A 9/1985 Sturman
4,607,819 A 8/1986 Spils
4,617,991 A 10/1986 Luetzelschwab
4,646,856 A * 3/1987 Dismukes ..... E21B 43/10 175/320
4,648,455 A 3/1987 Luke
4,669,541 A 6/1987 Bissonnette
4,725,038 A 2/1988 Heneker et al.
4,779,852 A 10/1988 Wassell
4,782,847 A 11/1988 Luetzelschwab
4,842,059 A 6/1989 Tomek
4,844,112 A 7/1989 Pick
4,872,808 A 10/1989 Wilson
4,901,413 A 2/1990 Cotherman
4,901,806 A 2/1990 Forrest
4,913,630 A 4/1990 Cotherman
4,981,175 A 1/1991 Powers
4,987,920 A 1/1991 Donner
5,072,749 A 12/1991 Ligh
5,133,419 A 7/1992 Barrington
5,141,055 A 8/1992 Chien
5,160,240 A 11/1992 Wilson
5,173,022 A 12/1992 Sango
5,207,810 A 5/1993 Sheth
5,215,286 A 6/1993 Kolenc
5,234,026 A 8/1993 Patterson
5,323,852 A 6/1994 Cornette
5,372,548 A 12/1994 Wohlfeld
5,389,128 A 2/1995 Lopes
5,431,228 A 7/1995 Weingarten
5,482,117 A 1/1996 Kolpak
5,516,360 A 5/1996 Normandeau
5,525,146 A 6/1996 Straub
5,588,486 A 12/1996 Heinrichs
5,641,271 A 6/1997 Forrester
5,653,286 A 8/1997 McCoy
5,732,929 A 3/1998 Luppino
5,736,650 A 4/1998 Hiron
5,837,152 A 11/1998 Komistek
5,890,508 A 4/1999 Powell
5,902,378 A 5/1999 Obrejanu
5,964,307 A * 10/1999 Wenzel ..... E21B 17/07 175/321
6,039,121 A 3/2000 Kisman
6,066,193 A 5/2000 Lee
6,113,675 A 9/2000 Branstetter
6,155,345 A 12/2000 Lee
6,244,563 B1 6/2001 Ejiri
6,260,619 B1 7/2001 Svedeman
6,277,286 B1 8/2001 Søntvedt
6,308,940 B1 10/2001 Anderson
6,422,312 B1 7/2002 Delatorre
6,484,801 B2 11/2002 Brewer
6,494,258 B1 12/2002 Weingarten
6,495,405 B2 12/2002 Voutsas
6,505,682 B2 1/2003 Brockman
6,547,005 B2 4/2003 Haheim
6,615,926 B2 9/2003 Hester
6,629,564 B1 10/2003 Ramakrishnan
6,676,366 B2 1/2004 Kao
6,679,323 B2 1/2004 Vargervik
6,701,957 B2 3/2004 McCarty
6,702,027 B2 3/2004 Olson
6,705,402 B2 3/2004 Proctor
6,715,556 B2 4/2004 Mack
6,723,158 B2 4/2004 Brown
6,740,216 B2 5/2004 Diakonov
6,755,978 B2 6/2004 Oddie
6,761,215 B2 7/2004 Morrison
6,782,920 B2 8/2004 Steinke
6,854,341 B2 2/2005 Oddie
6,868,907 B2 3/2005 Homstvedt
7,013,918 B2 3/2006 McCarty
7,044,240 B2 5/2006 McNeilly
7,131,497 B2 11/2006 Helms
7,174,959 B2 2/2007 Pratt
7,188,671 B2 3/2007 Al-Zahrani
7,225,881 B1 6/2007 Bushnell
7,241,104 B2 7/2007 Wilson
7,270,178 B2 9/2007 Selph
7,377,339 B2 5/2008 Wassell
7,455,115 B2 11/2008 Loretz

(56) References Cited

U.S. PATENT DOCUMENTS 7,461,692 B1 12/2008 Wang
7,462,225 B1 12/2008 Ketter
7,559,375 B2 7/2009 Dybevik
7,578,360 B2 8/2009 Haughom
7,654,344 B2 2/2010 Haughom
7,699,353 B2 4/2010 Smith
7,766,081 B2 8/2010 Brown
7,980,314 B2 7/2011 Mack
7,997,357 B2 8/2011 Wassell
8,066,077 B2 11/2011 Lawson
8,141,625 B2 3/2012 Reid
8,146,653 B2 4/2012 Naderi
8,146,680 B2 4/2012 Mock
8,276,669 B2 10/2012 Dykstra
8,312,931 B2 11/2012 Xu
8,387,662 B2 3/2013 Dykstra
8,448,699 B2 5/2013 Camilleri
8,555,975 B2 10/2013 Dykstra
8,556,580 B2 10/2013 Stair
8,607,874 B2 12/2013 Schultz
8,640,732 B1 2/2014 Beswick
8,734,535 B2 5/2014 Blum
8,739,880 B2 6/2014 Dykstra
8,747,078 B2 6/2014 Brown
8,789,589 B2 7/2014 Sihler
8,800,655 B1 8/2014 Bailey
8,919,432 B1 12/2014 Tetzlaff
8,950,513 B2 2/2015 Montgomery
9,109,410 B2 8/2015 Swietlik
9,121,255 B2 9/2015 Themig
9,187,981 B2 11/2015 Ocalan
9,200,642 B2 12/2015 Nowitzki
9,260,937 B2 2/2016 Chauveteau
9,260,952 B2 2/2016 Fripp
9,273,522 B2 3/2016 Hummes
9,347,279 B2 5/2016 Crowley
9,470,055 B2 10/2016 Harrigan
9,476,261 B2 10/2016 Venugopal
9,494,022 B2 11/2016 Coates
9,512,684 B2 * 12/2016 Khaparde ..... E21B 17/07
9,574,562 B2 2/2017 Van Dam
9,638,000 B2 5/2017 Dyck
9,638,207 B2 5/2017 Jayaram
9,695,645 B2 7/2017 Tilley
9,719,523 B2 8/2017 Jayaram
9,790,756 B2 10/2017 McNeilly
9,869,164 B2 1/2018 Tolman
9,903,185 B2 2/2018 Ursi
9,909,390 B2 3/2018 McNabb
10,053,956 B2 8/2018 Husveg
10,077,615 B2 9/2018 Authier
10,190,373 B2 * 1/2019 Vagapov ..... E21B 17/076
10,221,657 B2 3/2019 Gosselin
10,260,330 B2 4/2019 Reeves
10,267,135 B2 4/2019 Echenagucia Cioppa
10,337,252 B2 7/2019 Greenwood
10,371,154 B2 8/2019 Jayaram
10,378,323 B2 8/2019 Jouenne
10,400,569 B2 9/2019 Osborne
10,408,035 B2 9/2019 Kennedy
10,443,321 B2 10/2019 Cravatte
10,443,369 B2 10/2019 Obrejanu
10,533,376 B2 1/2020 Reimers
10,548,928 B2 2/2020 Grompone
10,583,373 B2 3/2020 Braaten
10,626,673 B2 4/2020 Slack
10,683,876 B2 6/2020 Brown
10,738,794 B2 8/2020 Rao
10,739,538 B2 8/2020 Kasai
10,753,504 B2 8/2020 Kumar
10,808,516 B2 10/2020 Brown
10,851,589 B2 12/2020 Gynz-Rekowski
10,883,354 B2 1/2021 Watson
10,989,234 B2 4/2021 Jouenne
10,995,770 B2 5/2021 Pagnier
11,008,847 B2 5/2021 Dyck
11,060,389 B2 7/2021 Wang
11,131,155 B2 9/2021 Brown
11,131,179 B2 9/2021 Brown
11,131,180 B2 9/2021 Ellithorp
11,162,338 B2 11/2021 Brown
11,299,973 B2 4/2022 Brown
11,391,140 B2 7/2022 Nordsveen
11,414,956 B1 8/2022 Burris
11,441,694 B2 9/2022 Kumar
11,492,888 B2 11/2022 Marshall
11,519,227 B2 * 12/2022 Peters ..... E21B 17/07
11,629,733 B2 4/2023 Eslinger
11,834,915 B2 12/2023 Massey
2001/0045300 A1 11/2001 Fincher
2002/0178924 A1 12/2002 Brown
2002/0189815 A1 12/2002 Johnson
2003/0079882 A1 5/2003 Mack
2003/0196802 A1 10/2003 Proctor
2004/0045708 A1 3/2004 Morrison
2004/0129457 A1 7/2004 McNeilly
2005/0155769 A1 7/2005 Sherwood
2005/0186065 A1 8/2005 Wilson
2005/0281683 A1 12/2005 Brown
2006/0131014 A1 6/2006 Huang
2006/0245945 A1 11/2006 Wilson
2007/0000695 A1 1/2007 Laflin
2007/0051509 A1 3/2007 Selph
2007/0235913 A1 * 10/2007 Chien ..... F16F 1/3605 267/149
2007/0284118 A1 12/2007 Benton
2008/0202816 A1 8/2008 Haughom
2008/0236839 A1 10/2008 Oddie
2008/0315471 A1 12/2008 Wassell
2009/0023502 A1 1/2009 Koger
2009/0065202 A1 3/2009 Brown
2009/0173540 A1 7/2009 Mock
2009/0272538 A1 11/2009 Kennedy
2010/0065280 A1 3/2010 Tetzlaff
2010/0089141 A1 4/2010 Rioufol
2010/0096140 A1 4/2010 Mack
2011/0057449 A1 3/2011 Marya
2011/0198126 A1 8/2011 Swietlik
2012/0097451 A1 4/2012 Mock
2012/0152518 A1 6/2012 Johanning
2012/0167818 A1 7/2012 Blum
2012/0199346 A1 8/2012 Patel
2012/0228029 A1 9/2012 Reimers
2012/0269614 A1 10/2012 Bassett
2013/0039782 A1 2/2013 Brown
2013/0240200 A1 9/2013 Frazier
2014/0076560 A1 3/2014 Kenyon
2014/0202768 A1 7/2014 Noske
2014/0216720 A1 8/2014 Wang
2014/0369868 A1 12/2014 Tetzlaff
2015/0044027 A1 2/2015 Van Dam
2015/0060084 A1 3/2015 Moen
2015/0101794 A1 4/2015 Canas
2015/0159466 A1 6/2015 Themig
2015/0204169 A1 7/2015 Coates
2016/0061003 A1 3/2016 Gottumukkala
2016/0177684 A1 6/2016 Parks
2016/0201444 A1 7/2016 Hardee
2016/0281486 A1 9/2016 Obrejanu
2016/0326836 A1 11/2016 Gonzalez
2017/0058655 A1 3/2017 Lastiwka
2017/0107771 A1 * 4/2017 Morse ..... E21B 17/07
2017/0151510 A1 6/2017 Cobb
2017/0204684 A1 7/2017 Cravatte
2017/0342781 A1 * 11/2017 Reimers ..... E21B 17/073
2018/0094515 A1 4/2018 Kennedy
2018/0237314 A1 8/2018 Xing
2019/0017518 A1 1/2019 Brown
2019/0152808 A1 5/2019 Krummel
2019/0162063 A1 5/2019 Brown
2019/0224586 A1 7/2019 Krummel
2019/0249537 A1 8/2019 Brown
2019/0264534 A1 8/2019 Gordon
2020/0141222 A1 5/2020 Wang

(56) References Cited

U.S. PATENT DOCUMENTS

| | | | |
|---|---|---|---|
| 2020/0141223 | A1 | 5/2020 | Brown |
| 2020/0291762 | A1 | 9/2020 | Ellithorp |
| 2021/0301636 | A1 | 9/2021 | Conrad |
| 2022/0056781 | A1 | 2/2022 | Tiwari |
| 2022/0195835 | A1 | 6/2022 | Acosta Villarreal |
| 2022/0349272 | A1 | 11/2022 | Patil |
| 2022/0381109 | A1 | 12/2022 | Hurtado |
| 2023/0108948 | A1 | 4/2023 | Brown |
| 2023/0111850 | A1 | 4/2023 | Sheth |

FOREIGN PATENT DOCUMENTS

| | | | |
|---|---|---|---|
| CA | 2534901 | A1 | 10/2004 |
| CA | 2794539 | A1 | 10/2011 |
| CA | 102678059 | A | 9/2012 |
| CA | 2816646 | A1 | 11/2013 |
| CA | 2887860 | A1 | 6/2014 |
| CA | 2831924 | A1 | 9/2014 |
| CA | 2871354 | A1 | 1/2015 |
| CA | 2966485 | A1 | 8/2016 |
| CA | 2902548 | A1 | 2/2017 |
| CA | 2940953 | A1 | 2/2017 |
| CN | 201953369 | U | 8/2011 |
| CN | 104675324 | A | 6/2015 |
| CN | 104718342 | A | 6/2015 |
| CN | 106761464 | A | 5/2017 |
| CN | 106837311 | A | 6/2017 |
| CN | 106894770 | A | 6/2017 |
| EP | 0065601 | A1 | 12/1982 |
| EP | 0862101 | A1 | 9/1998 |
| EP | 2072971 | A1 | 6/2009 |
| EP | 2474816 | A1 | 7/2012 |
| EP | 3258060 | A1 | 12/2017 |
| EP | 3396218 | A1 | 10/2018 |
| GB | 2436992 | A | 10/2007 |
| GB | 2529059 | B | 10/2017 |
| NO | 315209 | B1 | 7/2003 |
| NO | 322144 | B1 | 8/2006 |
| NO | 324265 | B1 | 9/2007 |
| NO | 325253 | B1 | 3/2008 |
| RU | 2278255 | C2 | 6/2006 |
| RU | 2514469 | C1 | 4/2014 |
| RU | 2685383 | C1 | 4/2019 |
| WO | 98/40600 | A1 | 9/1998 |
| WO | 2003062597 | A1 | 7/2003 |
| WO | 2008/047236 | A2 | 4/2008 |
| WO | 2011/056163 | A1 | 5/2011 |
| WO | 2012001671 | A2 | 1/2012 |
| WO | 2014178723 | A1 | 11/2014 |
| WO | 2015/020798 | A1 | 2/2015 |
| WO | 2015/041655 | A1 | 3/2015 |
| WO | 2015092334 | A2 | 6/2015 |
| WO | 2015/112908 | A2 | 7/2015 |
| WO | 2016/122329 | A1 | 8/2016 |
| WO | 2016/201443 | A1 | 12/2016 |
| WO | 2017105250 | A1 | 6/2017 |
| WO | 2018/237314 | A1 | 12/2018 |
| WO | 2019/173909 | A1 | 9/2019 |
| WO | 2020/072078 | A1 | 4/2020 |
| WO | 2020/236177 | A1 | 11/2020 |
| WO | 2022/170414 | A1 | 8/2022 |

OTHER PUBLICATIONS

Jianjun Zhu, A Review of Experiments and Modeling of Gas-Liquid Flow in Electrical Submersible Pumps, Energies 2018, 11, 180; doi:10.3390/en11010180, available Jan. 11, 2018, 41 pages.

The American Society of Mechanical Engineers, Measurement of Fluid Flow in Pipes Using Orifice, Nozzle, and Venturi, ASME MFC-3M-2004, available Aug. 15, 2005, 17 pages.

Absolutecompletions, FLUXRITE.wmv, screenshots of the YouTube Video available at https://www.youtube.com/watch?v=op3UhAIQjHU, available Feb. 5, 2010, 5 pages.

Ragnhild Krogsrud Haug, Multiphase Flow Through Chokes, Norwegian University of Science and Technology, available Jun. 2012, 41 pages.

British Standard, Measurement of fluid flow by means of pressure differential devices inserted in circular cross-section conduits running full, available Mar. 16, 2003, 21 pages.

Zhuoyi Li, Understanding the Roles of Inflow-Control Devices in Optimizing Horizontal-Well Performance, published in SPE Drilling & Completion, Sep. 2011, 10 pages.

Bela G. Liptak, Instrument Engineers' Handbook, 4th Edition. vol. 1: Process Measurement and Analysis, available 2003, 12 pages.

* cited by examiner

DRILLING DOWNHOLE REGULATING DEVICES AND RELATED METHODS

TECHNICAL FIELD

This document relates to drilling downhole regulating devices and related methods.

BACKGROUND

The following paragraphs are not an admission that anything discussed in them is prior art or part of the knowledge of persons skilled in the art.

The use of axial shock absorbers in a drill string is an industry practice, especially with roller cone bits. Improvements in axial shock absorbers with straight, axial splines to transmit torque and axial springs have led to the use of a separate counter springs with the purpose of balancing the "pump-open" force from differential pressure inside the tool and the hanging weight of drill string components below the device. A counter spring extends the effective operating envelope of the device to situations where the weight on bit is less than the pump-open force plus the hanging weight of components below the device.

Downhole regulating devices with a helical coupling that moderate the combination of downhole torque and axial force have been utilized with a single one-directional biasing device. Successful regulation of downhole vibrations are achieved by using a telescopic unit with a helical coupling that has a coupling with a steep lead angle. The unit is kept extended by a combination of the hanging weight of drilling string components below the device, pump-open pressure and a biasing device comprising a compression spring. When the bit sticks, the increased torque is converted by the threaded coupling into an axial contraction which relieves the weight on bit instantaneously and allows the bit to continue rotating smoothly. In many applications the weight on bit and torque are not sufficient to overcome the pump-open force and the hanging weight of the drilling string components below the device, and the result is that the device is rigid and ineffective.

In order to extend the effective operating envelope by placing the neutral point (position) of the tool between the fully contracted and fully extended positions, the use of a counter spring has been integrated with the helical coupling. The use of a counter spring extends the operating envelope to allow the regulating device to function at low weight improving the effectiveness. The first drawback of the counter spring design, is typically that a non-linear spring curve is provided. Once the second biasing device has fully extended the sensitivity to changes in axial and torsional loads is reduced. A second drawback is that a relatively long, heavy, and complex tool is required to provide the necessary stroke length between the fully extended and fully contracted positions. A third drawback with such a design is that the typical helical coupling lead angle of 40 to 80 degrees does not efficiently transfer torque spikes to axial movement because of friction in the helical coupling and bearings, and the net result is that the device is less responsive to small changes in torque or weight on bit.

SUMMARY

A downhole regulating device is disclosed for use in a drill string, the downhole regulating device comprising: a helical coupling between a lower portion and an upper portion of the downhole regulating device and structured to allow relative axial and rotational movement between the lower portion and the upper portion; and a bi-directional biasing device that resists movement between the lower portion and the upper portion in both axial extension and contraction directions and is arranged such that a neutral position of the bi-directional biasing device is between fully extended and fully contracted positions of the helical coupling.

A method is disclosed comprising: operating a drill string in a well to drill, ream, or mill; and in which, during operation, a downhole regulating device in the drill string acts to relatively axially extend and retract an upper portion, and a lower portion, of the downhole regulating device corresponding to an angular position of the upper portion relative to the lower portion, while a bi-directional biasing device of the downhole regulating device resists movement between the lower portion and the upper portion in both axial extension and contraction directions, in which the bi-directional biasing device is arranged such that a neutral position of the bi-directional biasing device is between fully extended and fully contracted positions of the downhole regulating device.

A downhole regulating device is disclosed for use in a downhole drill string, the downhole regulating device comprising: a plurality of helical couplings between a lower portion and an upper portion of the downhole regulating device and structured to allow relative axial and rotational movement between the lower portion and the upper portion in both directions from a neutral position, between a fully extended position and a fully contracted position; and a plurality of bi-directional biasing devices that resist movement between the lower portion and the upper portion in both axial extension and contraction directions and are arranged such that a neutral position of the downhole regulating device is between fully extended and fully contracted positions of the plurality of helical couplings.

A torsional spring is disclosed that comprises a laminate of metal on an inside with layers of carbon fiber on an outside.

A torsional spring is disclosed comprising a laminate of: a metal on an inside portion of the torsional spring; and a composite material on an outside portion of the torsional spring, the composite material having one or more layers functioning to improve the fatigue performance, or increase the spring rate, of the torsional spring when loaded in a constricting direction.

In various embodiments, there may be included any one or more of the following features: The helical coupling comprises a plurality of helical couplings arranged to modify performance characteristics or to provide a variable lead angle. The bi-directional biasing device comprises a helical spring that functions in a) torsion, b) both compression and tension, or c) torsion, compression, and tension. The bi-directional biasing device comprises a plurality of helical springs that act in parallel or series, with the plurality of helical springs arranged concentrically, intertwined, or connected end-to-end. The bi-directional biasing device comprises a bellows spring. The bi-directional biasing device comprises a pipe spring. The bi-directional biasing device defines a central fluid passage. The bi-directional biasing device comprises a plurality of helical springs whose helical spring coils shoulder on adjacent helical spring coils in the fully contracted position. The bi-directional biasing device comprises one or multiple intertwined helical springs whose helical spring coils shoulder on adjacent helical spring coils in the fully contracted position. The helical coupling has a right-hand thread and the bi-directional biasing device comprises a plurality of helical springs that are rigidly connected to the lower portion and the upper portion and function in combined torsion, compression, and tension, with a left-hand coil direction to reduce the magnitude of diametrical changes within the helical spring while it moves between the fully extended and the fully contracted positions. The helical coupling has a right-hand thread and the bi-directional biasing device comprises a plurality of helical springs, with a left-hand coil direction, that are rigidly connected to the lower portion and rigidly connected to the upper portion and function in combined torsion, compression, and tension. The bi-directional biasing device is rigidly fixed, axially and rotationally, to both the lower portion and upper portion, resisting both axial movement and rotational movement. The bi-directional biasing device is axially fixed to both the lower portion and the upper portion using a plurality of bi-directional thrust bearings or bushings. The primary and secondary elements of the bi-directional biasing device work together in the same direction to extend the downhole regulating device between a contracted position and the neutral position. A bi-directional thrust bearing is located between the first element of the biasing device and the helical coupling. A second bi-directional thrust bearing is located between the first element and the second element of the biasing device. The secondary element of the bi-directional biasing device is axially confined to avoid overextension when the primary element of the bi-directional biasing device is extended from the neutral position. The bi-directional biasing device functions in tension and compression and is rotationally de-coupled from the relative rotation of the upper and lower portions. The bi-directional biasing device comprises a primary element and a secondary element; the secondary element comprises a compressive spring; the secondary element modifies a spring rate or increases a stroke length in the contraction direction of the bi-directional biasing device; and the primary and secondary elements of the bi-directional biasing device work together in the same direction. The secondary element comprises a stack of disc springs. The bi-directional biasing device comprises a bellows spring that functions in compression and tension. The bi-directional biasing device comprises a pipe spring that functions in compression and tension. The bi-directional biasing device functions in torsion; and the bi-directional biasing device is rotationally fixed to both the lower portion and upper portion of the downhole regulating device using a plurality of splines or ball splines to resist relative rotational movement in the helical coupling. The bi-directional biasing device comprises a laminate of metal on an inside portion of the bi-directional biasing device with layers of a composite material on an outside of the bi-directional biasing device. Shoulders are employed to limit a stroke of the bi-directional biasing device in both extension and contraction. The helical coupling defines a helix angle of between 5 and 70, for example between 20 and 40 degrees, in some cases between 10 and 50 degrees. A drill string has a drill bit, a downhole motor, and the downhole regulating device. A method comprises arranging the downhole regulating device in a lower string portion of the drill string near a drill bit. The downhole regulating device is arranged above a downhole motor. The downhole regulating device is arranged below a downhole motor. Operating the drill bit in a well to drill, ream, or mill. A first helical coupling of the plurality of helical couplings has a lead with a first biasing device, of the bi-directional biasing device, that resists movement in a contraction direction; a second helical coupling of the plurality of helical couplings has a lead with a second biasing device, of the bi-directional biasing device, that resists movement in both extension and contraction directions; and the second helical coupling is arranged such that a neutral position is between fully extended and fully contracted positions. A lead of the first helical coupling is larger than the second helical coupling; the first biasing device comprises a compressive spring or set of disc springs; and the second biasing device comprises a torsional spring. A lead of the first helical coupling is larger than the second helical coupling; the first biasing device comprises a compressive spring; and the second biasing device comprises a helical spring that functions in a) torsion, b) both compression and tension, or c) torsion, compression, and tension. A second biasing device is configured with a compression spring that it is not in a load path of the bi-directional biasing device and works in parallel, wherein the second biasing device is not compressed while the regulating device is at the neutral point. The downhole regulating device is arranged below a reamer. The downhole regulating device is arranged above a reamer. The composite material comprises layers of composite wherein at least 50% and up to 100% of filaments of carbon fibers or glass fibers are substantially oriented in a direction of spiral spring coil. Fibers of the composite material are oriented in various directions. The composite material has a higher tensile strength than the metal. The composite material retards crack propagation on the outer surface of the torsional spring when loaded in the constricting direction and used in cyclic service. The metallic layer is thicker than the composite material. End connectors of the torsional spring are formed into axial ends of the torsional spring. The composite material extends beyond an axial length of a helical path defined by the torsional spring by a ration of 1 to 100 coil thicknesses. A metallic tubing is located along an axial length of coils of the torsional spring to prevent slippage of the composite material off of the metal in the event of delamination through the use of ridges, grooves, or other profiles that are substantially aligned with a coil spiral direction. The metallic tubing is prepared at axial ends of the torsional spring with a surface with grooves, ridges, wrench flats, or a gripping surface in cross section that serve to prevent twisting between the composite material and the metal in the event of delamination at the axial ends. The composite material is manufactured by: preparing a metal bar or tube with a surface profile and finish, and primed; wrapping the metal bar or tube with carbon fibers that are pre-pregnated with epoxy resin using a filament winding technique; and after curing, cutting one or more helical slots in a direction substantially aligned with a majority of the carbon fibers. The composite material has a higher tensile modulus than the metal. Higher modulus carbon fibers are located closer to a center of the torsional spring in cross section, and lower modulus uniaxial carbon fibers are located closer towards an outer surface of the torsional spring in cross section. The lower modulus uniaxial fibers located closer towards an outer surface of the torsional spring in cross section have a higher tensile strength than the high modulus fibers.

The foregoing summary is not intended to summarize each potential embodiment or every aspect of the subject matter of the present disclosure. These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Figure 1:
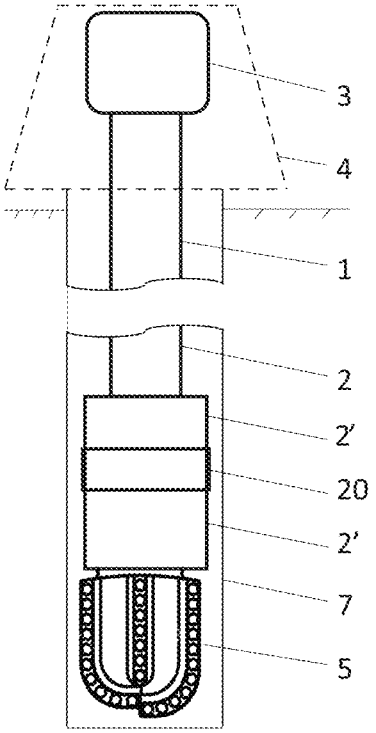
FIG. 1 is a side elevation view of a drill string disposed in a wellbore that penetrates an underground formation, the drilling device incorporating a regulating device.

Immaterial modifications may be made to the embodiments described here without departing from what is covered by the claims. The present disclosure relates to a regulating device and a method of using the regulating device in downhole drilling applications. The regulating device may be configured to mitigate axial and torsional drilling string dynamics that are known to damage drill string components, for example drill bits, motors, or directional tools.

Torsional vibrations are known in the industry as "stick-slip". In severe cases the drill bit may stop rotating during the "stick" portion of the cycle and then accelerate during the "slip" portion to a rotational velocity that is multiples of the rotational velocity of the drill string at surface. When torsional vibration occurs at very high frequency it is known as High Frequency Torsional Oscillation (HFTO), a phenomenon that may be challenging to measure due to the limited data rate of downhole sensors. A typical drilling Bottom Hole Assembly (BHA) may comprise drill collars, non-magnetic drill collars, downhole motor, Measurement While Drilling (MWD), Logging While Drilling (LWD), Rotary Steerable System (RSS) and other miscellaneous equipment such as jars, reamers circulation subs, floats, stabilizers and filter subs. When drilling, BHA component failures commonly occur as a result of vibrations, stalling or micro-stalling events.

As drilling technology has advanced, the torque and power capacity of downhole motors increased substantially. This has increased the load applied to BHA components and the severity of stick-slip events. Innovations in RSS technology have also led to an increase in the amount of critical BHA components being run beneath the motor. Components beneath the motor rotate multiple times faster than those above the motor and must withstand increased vibration amplitude and frequency.

Effective drill bit design is of crucial importance to reduce damage to the drill bit and other drill string components. Most drill bit designs include features to make them less aggressive and thereby less sensitive to sticking in situations where a hard formation is encountered or a depth of cut is excessive. Most Polycrystalline Diamond Compact (PDC) bits employ a negative rake angle, so that relatively less torque is produced in response to increased weight-on-bit (WOB). Many PDC bit designs also employ depth of cut control features such as passive backup cutters or ovoids. Such features may reduce the risk of torsional vibrations in the drill string. The downside of bit-design solutions may be that they do not reliably protect the BHA, and they may reduce the efficiency of the bits. Especially in hard rock, PDC bits with negative rake angles, depth of cut control features and chamfers on the cutter surfaces, may require relatively very high weight on bit to cut as they are intended to. Additionally, the friction that results from such high weight on bit and poor cutting efficiency may result in cutters dulling rapidly due to excessive heat.

Alternately, to reduce downhole vibration, a drilling method known as 'control drilling' may be employed. While control drilling, drilling parameters for example weight on bit may be reduced to limit the drill bit's depth of cut and associated torque generated by interaction between the bit and formation. Control drilling is generally successful in reducing downhole vibration; however, it may significantly impair the efficiency and rate of penetration achievable while drilling.

In the prior art, utilizing axial shock absorbers in a drill string is known, especially with roller cone bits. U.S. Pat. No. 4,186,569 describes an axial shock absorber with straight, axial splines to transmit torque and axial springs. This is an example of a bi-directional tool that uses a separate counter spring, with the purpose of balancing the "pump-open" force from differential pressure inside the tool and the hanging weight of drill string components below the device while working in non-horizontal inclinations. For the purposes of this patent, a bi-directional tool is defined as one that can telescopingly contract and extend relative to the neutral position. The counter spring may extend the effective operating envelope of the device to situations where the weight on bit is less than the pump-open force plus the hanging weight of components below the device.

The application of axial shock absorbers was reduced when roller cone bits were replaced with PDCs in most drilling applications. While roller cone bits generated significant axial vibration, PDCs do not.

Regulating devices with a helical coupling that moderate the combination of downhole torque and axial force are known from the publication U.S. Pat. No. 2,754,086. Regulation of downhole vibrations are achieved by using a telescopic unit with a helical coupling that has a steep lead angle or lead. Lead is defined as the axial advance of a helix or screw during one complete turn (360°). Lead angle is the angle between the helix and a plane of rotation, and are related by the pitch diameter of a lead screw according to the following equation: Lead=tan(Lead Angle)*3.14*Pitch Diameter. The unit is kept extended by a combination of the hanging weight of drilling string components below the device, pump-open pressure and a biasing device, namely a compression spring. When the bit sticks, the increased torque is converted by the helical coupling into an axial contraction that relieves the weight on bit instantaneously and allows the bit to continue rotating smoothly. However, in many applications the weight on bit and torque are not sufficient to overcome the pump-open force and the hanging weight of the drilling string components below the device, with the result being that the device is rigid and ineffective. Even in situations where the "normal" drilling parameters allow the device to operate between fully extended and fully contracted positions, the device is less effective, especially when drilling is initiated against the work surface, or in extreme "slip" events.

In order to extend the effective operating envelope by placing the neutral point of the tool between the fully contracted and fully extended positions, U.S. Pat. No. 3,998,443 employs two biasing devices with one located above and another below the helical coupling. Extending the operating envelope to allow engagement at low weight on bit and torque provides advantages to drilling operations. However, a drawback of this design is that the biasing devices are comprised of compressible fluid chambers which experience extremely high pressures in a challenging service for which reliable seals have not yet been established. Compressible fluids also tend to heat up substantially when subjected to extreme services such as the proposed regulating device which further increases the pressure in the chambers and results in a variable spring rate. This patent also teaches to provide damping which is achieved by restricting the flow of a largely incompressible fluid between two chambers. Similar bi-directional functionality from the neutral point, but without a helical coupling, is achieved with two compressible fluid chambers in the bi-directional regulating device of U.S. Pat. No. 5,133,419.

In order to achieve bi-directional movement from the neutral point, the regulating device U.S. Pat. No. 4,276,947 utilizes a single compression spring, comprised of a stack of roller Belleville springs, which is configured to be compressed during both contraction and extension of the device. A helical coupling is not used. The roller Belleville springs are a variant of typical Belleville (disc) springs which promise to reduce friction and overloading which are inherent challenges of Belleville springs. A preload is used to compress the spring pack a small amount when it is in the neutral position. The primary drawback is that a bi-directionally loaded compression spring will have "dead zone" within the travel due to the preloaded. The "dead zone" exists when forces exerted on the spring do not exceed the preload in either the contraction or extension directions, and this results in reduced responsiveness of the device or in a worst case, damaging vibrations induced by the device while functioning around or through the "dead zone". One might think therefore that a very small or zero preload is optimal; however, this is not practical. Most spring designs will tend to "set" when initially loaded, and "creep" during extended and severe service. In the case of a stack of Belleville washers, set and creep will result in a shortening of the free height of the spring pack and a loss of the preload. When the preload is lost, instead of exhibiting a "dead zone" there will instead be a "slop zone" wherein unconstrained extension or contraction of the device will occur between the position to engage the springs in the upwards and downwards directions. This "slop zone" is deleterious to the shock absorption function of the device and may result ineffective shock absorption or in a worst case, damaging vibrations induced by the device.

In order to achieve similar bi-directional functionality and an increasing spring rate an alternative to roller Belleville springs is proposed in U.S. Pat. No. 7,997,357 where special end spacers are used and the spring stack is comprised of two sections of Belleville springs each having a unique spring rate.

A bi-directionally loaded compression spring is incorporated into a helical coupling regulating device in U.S. Pat. Publication No. 2017/0342781 where it is used as a secondary biasing device "counterspring". The first drawback of such a counter spring design, is that the spring curve is non-linear. Once the second biasing device has fully extended, sensitivity to changes in axial and torsional loads is reduced. A second drawback is that a relatively long, heavy, and complex tool may be required to provide the necessary stroke length between the fully extended and fully contracted positions. The increased length and weight of this tool may be a noteworthy concern when ran beneath a downhole motor as such increases the loads on the motor bearing pack and power section that can result in accelerated wear and premature failure. A third drawback is that higher levels of friction are generated by the many bearing faces and long inner sleeve which may contact various other components within device when subjected to bending through doglegs in a directionally drilled wellbore. Devices with opposing springs, particularly those which do not employ thrust bearings at every bearing surface will inherently experience much higher levels of friction. Friction is undesirable in almost all shock absorber applications, because friction results in sticking followed by sudden jerky movements. Additionally, friction makes the device less responsive to small changes in torque or WOB.

Moderately high levels of friction when responding to torsional inputs are inherent with known configurations that use an axially loaded spring to absorb the primarily torsional shocks and high frequency torsional oscillations that are created when drilling with PDC bits, because of the friction in the helical coupling, where the helical coupling converts a torsional input to an axial motion through a relatively steep helix lead angle, typically in the range of 40 to 80 degrees. Ball splines promise to reduce the friction of the helical coupling but have not yet proven reliable in downhole drilling service.

Further adaptations have been made to helical coupling regulating devices for various applications through the use of orifices, pressure balancing, use of elastomers at various interfaces, improved or customizable damping characteristics, and multiple splined sections. Various examples include: U.S. Pat. Nos. 4,901,806A, 6,308,940B1, 7,044, 240B2, 7,578,360B2, US20120228029A1, U.S. Pat. No. 9,512,684B2, U.S. Ser. No. 10/190,373B2, U.S. Ser. No. 10/626,673B2, U.S. Pat. Nos. 7,377,339B2, 9,109,410B2, EP65601, U.S. Pat. No. 4,466,496, WO2016201443, NO325253, US20120228029, CN102678059, CN106837311, CN106894770, U.S. Pat. Nos. 3,156,106, 3,323,326, 3,998,443, 4,270,620, 3,339,380, 4,443,206, 2,754,086, 1,785,086.

Devices which attempt to mimic the function of a helical coupling through other means include: U.S. Pat. No. 7,654, 344B2, GB201412778.

Other shock subs of particular interest include: U.S. Pat. Nos. 3,963,228, 9,347,279, 9,187,981, 3,947,008. Devices which utilize a helical coupling and biasing device for other non-drilling-regulating purposes for well construction and operations include: U.S. Ser. No. 10/221,657, U.S. Pat. No. 7,225,881.

Known regulating devices that use a helical coupling and disc springs may require a relatively steep helix lead angle in the range 40 to 80 degrees, or a lead of 10 to 100 inches per rotation. A lower lead angle of 5 to 40 degrees or a lead of 1 to 10 inches per rotation may be more optimal for mitigating PDC-bit induced torsional vibrations but may require use of a torsional spring to avoid excessive friction and binding in the regulating device and thrust bearing assembly.

The present disclosure proposes to improve upon the known regulating devices discussed above, or at least provide a useful alternative.

A regulating device according to the present disclosure may be an improvement upon features known from axial and helical-coupling (co-directional) shock absorbers for drill strings.

Figure 2:
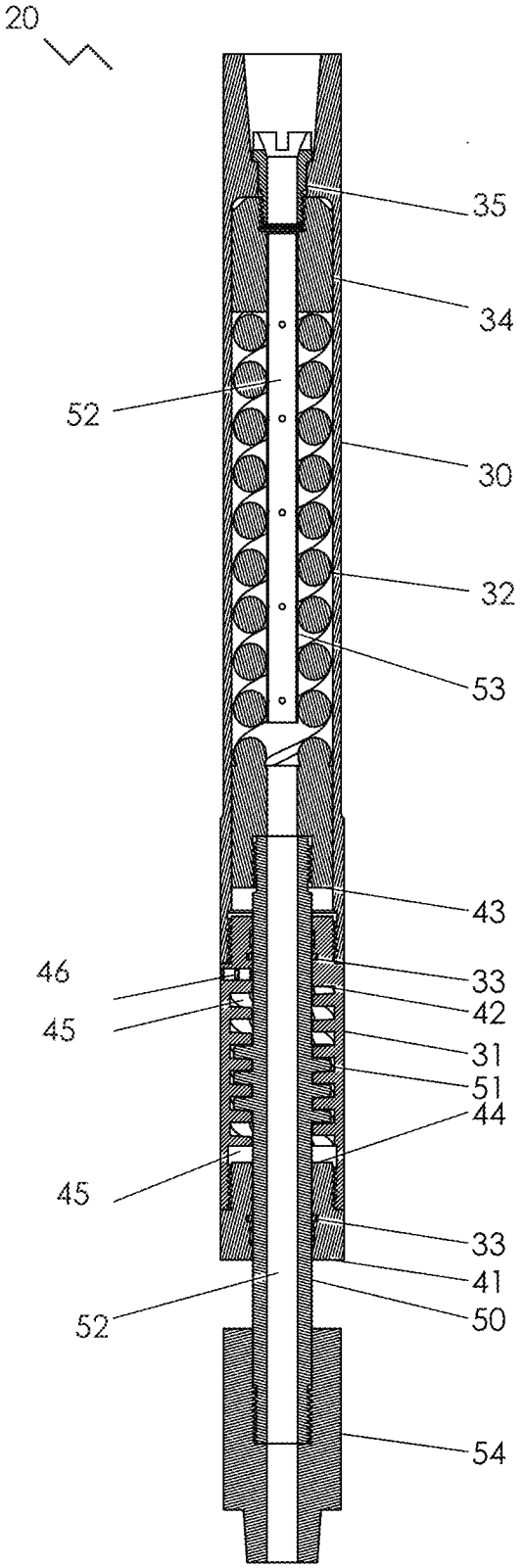
FIG. 2 is a cross-sectional view of an embodiment of a regulating device with a helical coupling and a helical spring.

Referring to FIG. 2, the present disclosure includes a regulating device 20 for use in a downhole drill string 1. The regulating device 20 may comprise: a telescopic part, such as a helical coupling (guides 31 and 51), between a lower portion, such as tool joint 54 or other lower connector, and an upper portion, such as a top connector 34, of device 20. The telescopic part may allow relative axial and rotational movement of the regulating device 20 in opposite directions between a fully extended position and a fully contracted position. A bi-directional biasing device 32 may be present and structured to resist movement in both extension and contraction directions. Device 32 may be arranged such that the neutral point or position is between the fully extended and fully contracted positions of the helical coupling. The biasing device 32 may be designed such a way that a pre-charge load or pre-tensioning is not required. The device 32 may comprise a single part, such as a helical spring, connected to both the upper and lower portions of the device 20 to resist movement in both axial directions. The device 32 may be directly connected to transmit axial and rotational movements, or isolated from rotational movements with a bearing at either end, or isolated from axial movements with a spline at either end.

Embodiments of the present disclosure may achieve an effective operating envelope, wherein the neutral point of the tool is located between the fully contracted and fully extended positions. For example, the neutral point may be located at a position where it can expand by a certain distance (x), and contract a different distance (y). The contraction distance (y) may be equal to 2×, 5×, 10×, or 50×. Such effect may be achieved using a single biasing device that smoothly functions in both directions about the neutral point, as opposed to known biasing devices which must be preloaded and compressed in both directions. While (the bit is) off bottom, tension from the hanging weight of the BHA and pump open force generated by fluid flow through the BHA may extend the biasing device from the neutral position. As bit is placed on bottom, weight is applied, torque is generated, and the biasing device contracts. In some cases, the device 32 may be structured or calibrated to be in the neutral position in normal operating drilling conditions. In some cases, the device 32 may be structured or calibrated to be in the fully extended position when (the bit is) off bottom. The biasing device 32 may have an operating envelope that allows for engagement and mitigation of torsional shock loads while the device is extended or contracted.

The regulating devices disclosed here may autonomously reduce vibration generated by the bit. An increase in weight or torque from the drill bit forces the regulating device to contract, reducing the weight and torque on the bit. A reduction in weight or torque from the bit forces the regulating device to extend, increasing the weight and torque on the bit. This ability to level the drilling loads on the bit may reduce the vibration generated at the bit and correspondingly, the vibration observed by all BHA components.

A single biasing device may resist axial forces, transmitting forces between the lower portion and upper portion through a bi-directional thrust-bearing. A single biasing device may resist torsional forces and transmit forces between the lower portion and upper portion through a suitable transfer mechanism such as a spline or ball spline. A single biasing device may be secured, for example anchored, for further example rigidly connected to both the lower portion and upper portion without need of a bearing and may transmit both axial and torsional forces. Because only a single biasing device may be required and may be ran at neutral load, with no pre-charge, the tool may be relatively short and light weight compared with other known tools, reducing fatigue on motor components when ran beneath a motor, and friction may be reduced.

Some embodiments may have the female portion of the helical coupling disposed on top with the biasing device contained within the female portion. This configuration may protect the biasing device from wear against the borehole while rotating, and if the device breaks, may contain any loose pieces within the tool. Additionally, such a configuration may minimize the "sprung weight" below the helical coupling which may be desirable to improve the responsiveness and effectiveness of the entire system.

Referring to FIG. 1, a regulating device 20 may be positioned in the drill string 1 above or below a drilling motor 6, for example in some non-limiting cases:

a. Usually located below the motor if a rotary steerable system is employed,
b. Usually located above the motor and MWD if a rotary steerable system is not being used, and
c. If a downhole motor is not used the device may be located as close to the drill bit as is practical.

The biasing device may be located over the male portion or in the female portion or both.

The regulating device may incorporate load shoulders at either end of the operating envelope of the biasing device in both extension and contraction. The load shoulders may be the ends of the helical coupling. The load shoulders may be positioned to prevent the biasing device from exceeding its designed stress and travel limits. A secondary benefit may be that should the biasing device fail, drilling may continue, as after shouldering in contraction, drilling loads may be transmitted through helical coupling. Similarly, the shoulder in extension may allow the lower portion of the tool to retrieved to surface should the biasing device fail.

In some embodiments an inner sleeve may be used through the single biasing device to prevent buckling or erosion of the biasing device and reduce the turbulence and pressure drop of drilling fluid pumped through the device. Alternatively, the single biasing device may be exposed to the drilling fluid through the center biasing device to allow cooling and limit friction and binding.

In some embodiments, a secondary element of the biasing device may be run in combination with the primary element of the biasing device to extend the stroke achieved by the regulating device in contraction. The secondary element in this application may be oriented in the same direction as the primary element and may be ran with or without pre-charge. The secondary element of the biasing device may have low preload such that it activates after the weight on bit and torque generated through drilling exceed the hanging weight of the BHA and pump open force below the tool. In another embodiment the secondary element is preloaded such that it only begins to compress when the primary element is near the extent of its travel in the compressive direction. The secondary element may be axially contained between two shoulders, one shoulder being axially connected to the primary element of the biasing device. The telescoping movement of the primary element of the biasing device may apply axial loads on the secondary element, providing the regulating device additional stroke. The secondary element may comprise a compression spring such as a disc spring, however a compressible fluid piston or other type of spring may also be used.

In some embodiments, a secondary biasing device may be run in parallel with the primary biasing device to extend the operating envelope of the regulating device and reduce the stress on the primary biasing device. The secondary biasing device may comprise a helical spring, a compression spring such as a disc spring, compressible fluid piston or other type of spring and may not be in the same load path as the primary biasing device. For example, the primary biasing device may be a bi-directional helical spring located over the male portion while the secondary biasing device may be a disc spring located in the female portion. The secondary biasing device may function bi-directionally to assist in both extension and contraction of the regulating device, or only on contraction. The secondary biasing device may resist axial forces, transmitting forces between the lower portion and upper portion through a bi-directional thrust-bearing. The secondary biasing device may resist torsional forces and transmit forces between the lower portion and upper portion through a suitable transfer mechanism such as a spline or ball spline. The secondary biasing device may be secured, for example anchored, for further example rigidly connected to both the lower portion and upper portion without need of a bearing and may transmit both axial and torsional forces.

The regulating device may be utilized by a drilling rig comprising a drilling unit with top drive, a drilling unit with a rotary table, a servicing rig using only a downhole motor, a servicing unit with a power swivel, a servicing unit with a top drive, or a coil tubing unit.

In what follows, examples of embodiments are described and visualized in the accompanying drawings.

FIG. 1 illustrates a drawing of a drill string 1 extending from a drilling rig 4 to a drill bit 5 and motor 6 with a regulating device 20, which according to the present disclosure, is located in a lower portion 2' of the drill string 1. The drill bit 5 may be used to drill a formation and extend a well or wellbore 7, or may be used within steel casing to drill cement, plugs, fish, or other materials that are inside the casing. The drill bit 5 may be a PDC drilling bit, but may also be a roller cone or mill, or other suitable part. The drill string 1 may be rotated at surface by the drilling rig 4, typically using a top drive 3, but may also be done with a rotary table, power swivel, or other suitable drive system. The upper portion 2 of the drill string may comprise drill pipe, heavyweight drill pipe, tubing, or drill collars (in shallow horizontal drilling applications). The lower portion 2' of the drill string 1 may be considered the "bottom hole assembly" (BHA) and may comprise one or more drill collars, non-magnetic drill collars, downhole motor, Measurement While Drilling (MWD), Logging While Drilling (LWD), Rotary Steerable System (RSS) and other miscellaneous equipment for example jars, reamers circulation subs, floats, stabilizers and filter subs. The regulating device 20 may be located in the drill string 1. The regulating device 20 may be located in the lower portion 2' of the drill string 1, and in some cases as close to the drill bit 5 or reamer as possible. Plural regulating devices 20 may be employed within the drill string 1, for example for reaming while drilling applications, a regulating device may be placed between the bit and the reamer with one or more regulating device(s) above the reamer. For conventional non-directional drilling assemblies, the regulating device 20 may be connected directly to the bit 5. For directional drilling assemblies utilizing a motor with bent housing, the regulating device 20 may be connected above the motor, or above the MWD, or above the LWD. For directional drilling with a RSS, the regulating device 20 is typically installed below the motor.

Figure 1A:
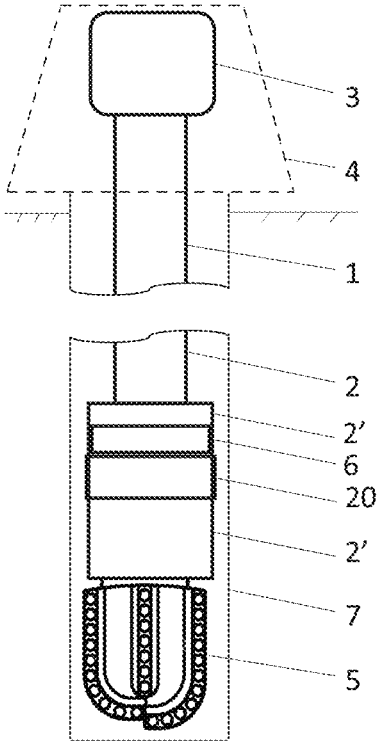
FIG. 1A is a side elevation view of a drill string disposed in a wellbore that penetrates an underground formation, the drilling device incorporating a regulating device below a downhole motor.

FIG. 1A shows the regulating device 20 installed below the downhole motor 6. It may be beneficial to install the regulating device 20 below the downhole motor 6 so that the regulating device 20 may not be affected by motor differential pressure. The regulating device and the downhole motor are both located within the lower portion 2' of the drill string 1. Downhole motors may create torque and differential pressure that are typically proportional during normal operations. However, when the bit catches the motor torque increases which in turn causes a concurrent differential pressure increase, if the regulating device is located above the motor then this increase in differential pressure may increase the pump-open hydraulic force within the regulating device 20, counteracting the desired contraction movement of the regulating device 20 at this time. If it is necessary to install the regulating device 20 above the motor, then it may be desirable to utilize a helical coupling with a relatively lower lead angle in order to make the regulating device 20 more sensitive to torque and less sensitive to pump-open forces. Alternatively, known configurations to pressure-balance the device may be used. Helical couplings with a low lead angle (for example less than approximately 40 degrees) may be ineffective in combination with traditional designs that employ only axial (compression) springs, because the spring force direction may be poorly aligned with a low helix lead angle and results in excessive friction and binding which reduce the responsiveness of the device. Biasing devices that resist torsion for example those further described in FIGS. 2, 5, 6, 8, and 9 may enable said smaller helical coupling lead angles to be effectively used.

FIGS. 2-9 each show cross section views of different embodiments of the regulating device 20.

FIG. 2 illustrates a cross section of an embodiment of a regulating device 20. A female portion which is referred to as a housing 30 may encapsulate the biasing device 32. The biasing device 32 may comprise two left-hand helical springs arranged in parallel (intertwined configuration). Right-handed helical springs may also be used. The cross section of the helical springs may be circular. An inner sleeve 53 may be used to support the biasing device 32 and may provide a smooth fluid conduit to reduce friction pressures while pumping drilling fluid through the regulating device 20. The sleeve 53 may avoid erosion of the biasing device 32 by abrasive drilling fluid travelling at high velocity. A fluid channel 52, such as a fluid passage as shown, may exist, for example be defined, through the entire regulating device 20 to supply drilling fluid to the drill bit 5. The biasing device 32 may be within the female portion 30 of the regulating device. A helical coupling may comprise a female helical guide 31 and a male helical guide 51, disposed telescopically in the guide 31, and that connects the housing 30 to the male or inner portion 50. Relative motion between the male portion 50 and the female portion may be constrained to the helix angle of helical coupling. The potential maximum rotational and axial displacement that may occur between the housing 30 and the male portion 50 may be constrained by shoulders 41, 42, 43, 44. The device may be designed such that the shoulders 41,42, 43, 44 are not active during regular operations (for example in neutral) such as rotating off bottom, circulating off bottom, or drilling with typical drilling parameters. The shoulders 41,42, 43, 44 may be required to transmit higher forces during non-routine drilling events for example when the drilling assembly below the regulating device 20 is stuck. The maximum contraction may be controlled by contracted shoulder 41 or alternate contracted shoulder 42. The maximum extension may be controlled by extension shoulder 43 or alternate extension shoulder 44. An additional benefit to the shoulders 41, 42, 43, 44 may be that should the biasing device 32 fail, drilling or back reaming may continue through use of the contracted shoulder 41, 42 or extension shoulder 43, 44 respectively.

A tool joint 54 or other drill string connector may be provided on the end of the male portion 50 for safe and convenient handling on the drilling rig 4. While it would be possible to provide flow restrictors and lubricate the helical coupling with drilling fluid, drilling fluid lubrication may be more effective with roller or ball type bearings. However, ball bearings may be challenging to implement considering the severe service application and high loads that the helical coupling may transmit. It is therefore believed that the more cost effective and reliable solution may be to use a helical coupling as shown in FIG. 2 with seals assemblies 33 that isolate a fluid chamber 45 which may be filled with lubrication oil. The seal assemblies 33 may include scrapers to protect the seals, wear bushings, and radial bearings to control lateral movement and transmit bending moments from the male portion 50 to the housing 30. A pressure balancing device 46 may be used to allow for a change in volume of the fluid chamber 45 that protects the seal assemblies 33 from severe pressure differentials that are expected to occur when the regulating device 20 is conveyed from surface to downhole conditions (often exceeding 6000 psi), or from thermal overpressure when the oil heats up extremely high pressures can be generated. The sealed fluid chamber 45 may also be utilized to provide damping because the helical coupling provides a restriction to oil movement from one axial end to the other of the helical coupling. Clearances between the male portion (guide 51) and female portion (guide 31) of the helical coupling may be controlled and oil viscosity may be controlled to provide the desired amount of damping at downhole conditions. As the surfaces of the helical coupling wear during operation of the regulating device, the amount of damping may decrease corresponding to wear and enlargement of the clearances in the helical coupling.

Seal, scraper, and wear bushing designs may be important for reliability of function, however also of importance may be surface finish and properties of the countersurface which the seal assemblies 33 are sliding against. The countersurface may be smoothly polished with a hard surface treatment for example induction hardening, hard chrome, various carbides or ceramics, other hard metals applied by high velocity oxygen fuel (HVOF) process, nitride or others as is known in the industry to reduce friction and wear rates on the countersurface. Similar coatings and surface treatments may be applied to the mating surfaces of the helical coupling. Such may be used for sliding metal-on-metal bearings like the helical coupling for dissimilar metals to be used on each surface.

The biasing device 32 may be connected with a top connector 34 and a top assembly screw 35 to the housing 30. This configuration may limit the number of housing connections and may allow the housing 30 to be constructed with robust connections that are important when considering the bending moments that the housing 30 may carry while rotating in high doglegs (bends) in the wellbore 7, which otherwise lead to fatigue. In this embodiment there are no bearings connecting the biasing device 32 to the male portion 50 or the top connector 34. The biasing device 32 may accommodate both axial and rotational movement as defined by the helical coupling while creating reactive axial and torsional forces. This embodiment may be advantageous because the combined loading of the biasing device 32 may further reduce friction losses through the helical coupling. The combined loading of the biasing device 32 may align the biasing device reaction force with the direction of travel in the helical coupling which may reduce side loading and friction within the helical coupling. Additionally, this embodiment may not require additional bearings or splines, which have the potential to bind or seize and add friction and complexity to the regulating device 20.

The helical coupling may be assembled in a manner where the neutral position (which may be defined as the position without external loads being applied), is between the fully extended position and the fully contracted position. The coupling may be free to move either direction (extension or contraction). During use it would be typical for the regulating device 20 to be in an extended position while tripping due to hanging weight from components below the regulating device 20, and further extended while circulating off-bottom due to pump open forces that occur because the fluid pressure is higher inside the tool than outside. The regulating device 20 may be designed to only extend to the fully extended position and shoulder during non-routine operations for example when components below the regulating device 20 become stuck.

In the figures shown the seal assemblies 33 may be disposed in grooves in the female component or housing 30. Such may provide reliability, lower friction, and lower cost. Alternatively, seals may be disposed in grooves in the male component or portion 50, for example if such better suits assembly requirements.

Seal assemblies 33 may not be required, and an alternative embodiment may use the drilling fluid to lubricate the helical coupling. In a "mud lube" configuration the seal assemblies 33 may be replaced by flow restrictors that limit the amount of drilling fluid that leaks out through the tool to a small fraction of the total flow. A flow restrictor may be a low clearance mating between female and male portions with a wear and erosion resistant surface that limits the flow rate of the drilling fluid that leaks past the flow restrictor. The drilling mud that leaks past the flow restrictor may provide essential cooling and cleaning of the helical coupling. A drawback of a mud lubricated helical coupling is higher wear rates on the helix surfaces, and higher friction coefficients caused by solid particles within the drilling fluid. The regulating device 20 is shown in the neutral position between fully extended and fully contracted positions. There may be more available distance to be travelled before fully contracting the tool onto the contracted shoulder 41 as compared to the available distance to be travelled before fully extending the tool onto the extension shoulder 43.

Figure 3:
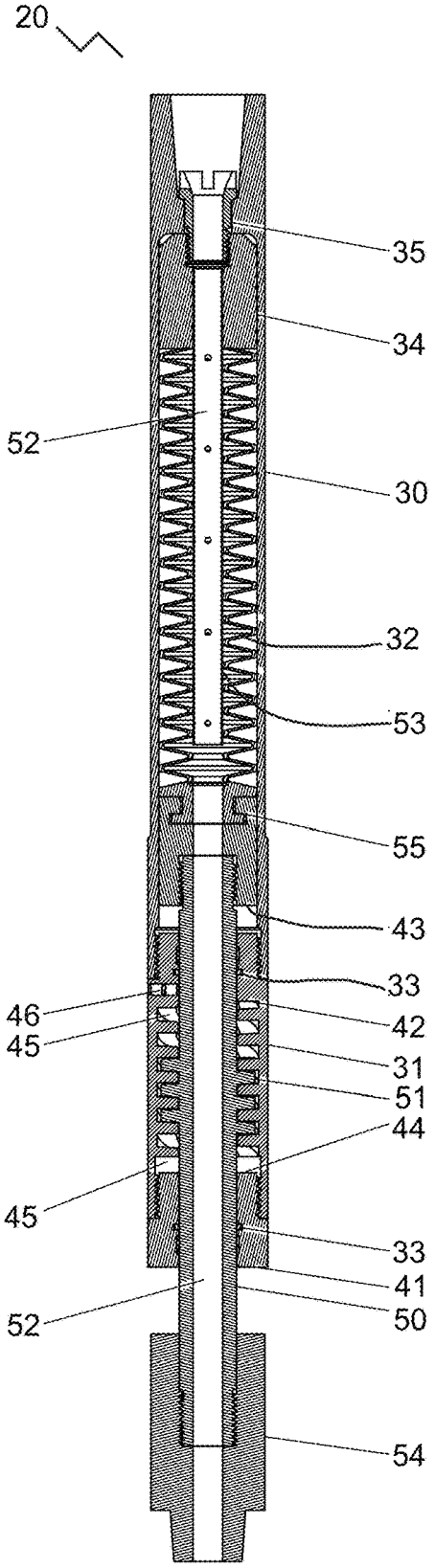
FIG. 3 is a cross-sectional view of an embodiment of a regulating device with a helical coupling and a bellows spring.

FIG. 3 illustrates an alternative embodiment of the regulating device 20, wherein the biasing device 32 may be a bellows spring. A bellows spring may be similar to a stack of Belleville washers, except that each cone is connected to the next such that it functions in both tension and compression similar to the helical spring discussed previously. A bellows spring may not accommodate relative rotation and therefore may be connected to the male portion 50, for example using a bi-directional bearing 55. A simplistic bearing is represented in this figure for clarity, but a sealed bi-directional roller thrust bearing assembly may be used. A bi-directional thrust bearing is defined as an assembly that allows unconstrained rotation while transmitting axial forces in both directions. Bi-directional thrust bearings may include bushings, double-direction ball or roller bearing with separate races for transmission of forces in each direction. Angular contact thrust ball bearings with separate races for transmission of forces in each direction or conventional ball bearings that are capable of transmitting radial and axial forces in both directions may be used. Multiple ball bearings may be stacked to function together as required to obtain the required capacity as is known in the art. Perforations in the bellows spring are not shown, but may be used to allow fluid passage in and out of the space between the biasing device 32 and the housing 30. An inner support sleeve 53 may be employed, which may be perforated to allow fluid passage in and out of the space between the biasing device 32 and the inner support sleeve 53. A bellows spring may be manufactured from a variety of techniques.

Figure 4:
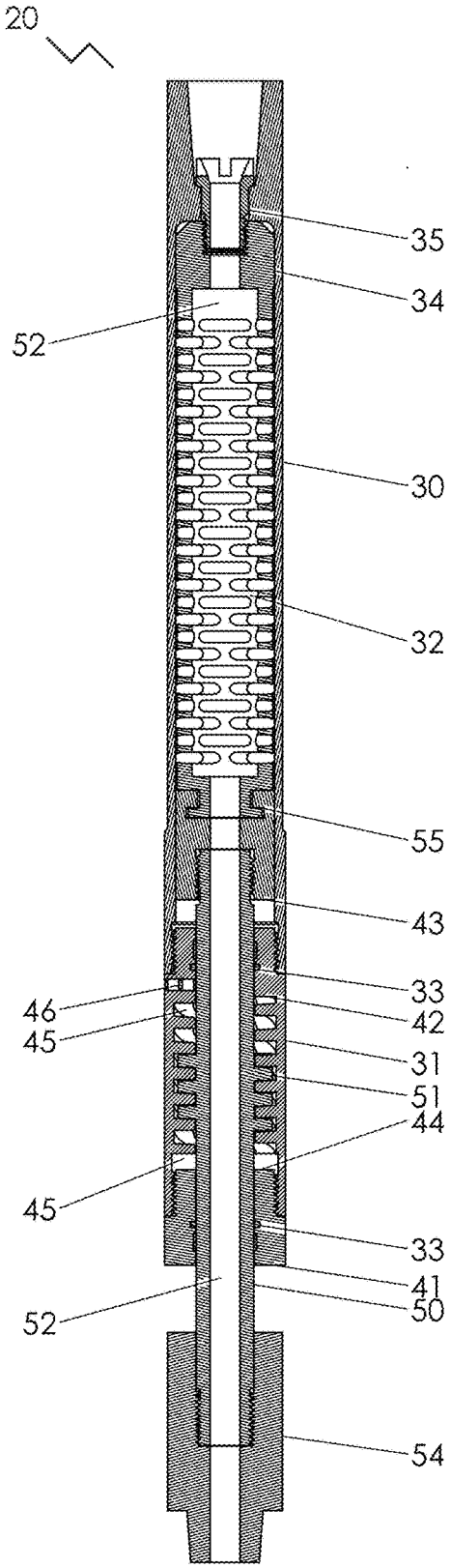
FIG. 4 is a cross-sectional view of an embodiment of a regulating device with a helical coupling and a pipe spring.

FIG. 4 illustrates an alternative embodiment of the regulating device 20, wherein the biasing device 32 is a pipe spring. A pipe spring may function in both tension and compression similar to the helical and bellows springs discussed previously. The biasing device 32 may be connected to the helical coupling with a bi-directional bearing 55 or other suitable connection. Pipe springs are relatively inefficient for energy storage and may be expected to require a relatively large spring to obtain the same stroke length and low spring rate as compared to other types of biasing devices.

Figure 5:
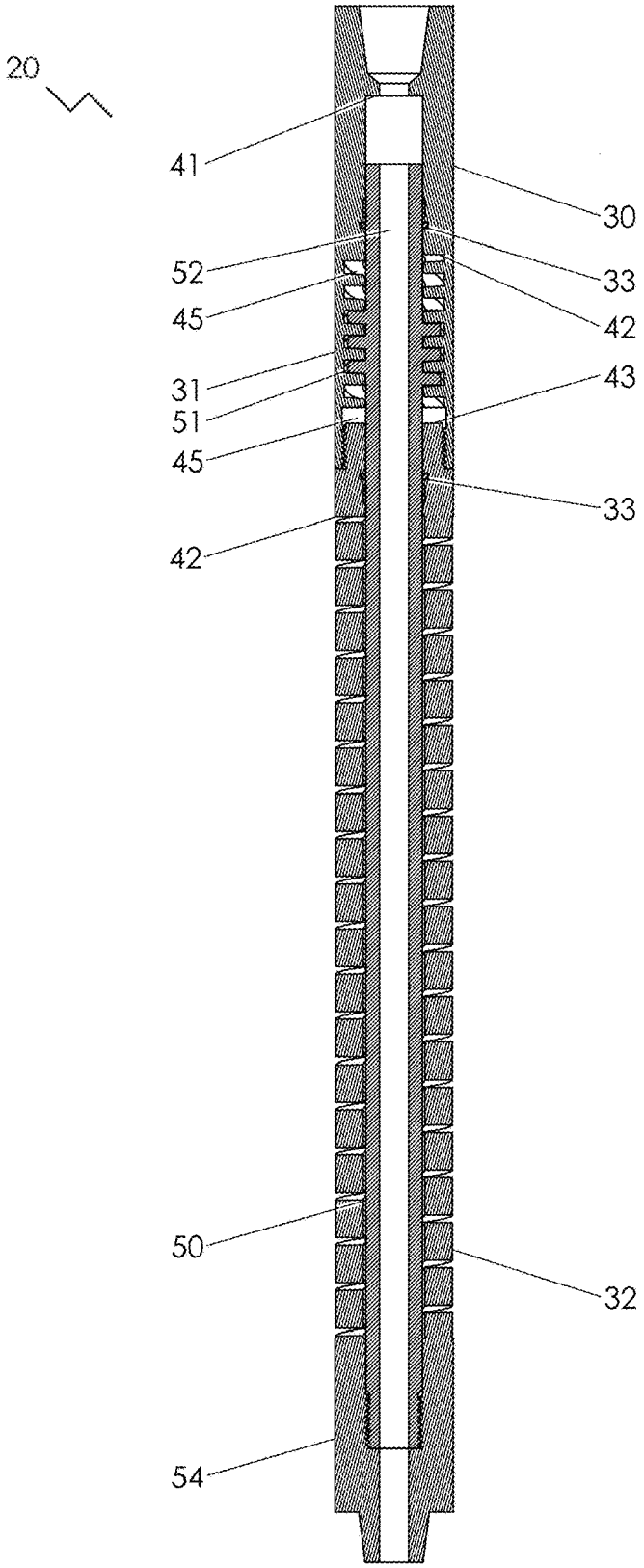
FIG. 5 is a cross-sectional view of a further embodiment of a regulating device with a helical coupling and a helical spring.

FIG. 5 illustrates an alternative embodiment of the regulating device 20, wherein the biasing device 32 is positioned over the male portion. In this embodiment a sleeve may be provided around the exterior of the biasing device 32 but is not shown in this figure. An outer sleeve may protect the biasing device 32 from wear and contain broken pieces if the biasing device 32 breaks. This configuration may benefit from a reduction in the number of parts and assembly complexity. A drawback of this design without an outer protective sleeve or housing may be that biasing device 32 breakage could cause the regulating device 20 to become stuck in the wellbore 7. The biasing device 32 may be a single helical spring, for example with a rectangular cross section. The helical spring may be so large that it may be challenging to manufacture with conventional wire wrapping techniques and may be instead manufactured from a metallic tube. End connections may be challenging to manufacture and assemble with a conventional wire-wrapped coil spring. End connectors may be easily integrated when the spring is manufactured from tubing input material and helical slots are removed to create the helical spring profile. The slots may be cut by machining process, water cutting, laser cutting, electrical discharge manufacturing (EDM), or other suitable processes. A laminated metal and composite spring to enhance torsional stiffness and fatigue performance may be employed as described further in FIG. 6. The configuration of FIG. 5 with the spring disposed outside the male portion 50 may allow for more efficient spring design because helical springs may be more efficient when the diameter is much larger than the thickness. In the industry this ratio of diameter/thickness may be known as the spring index and is preferentially greater than 4.

Figure 6:
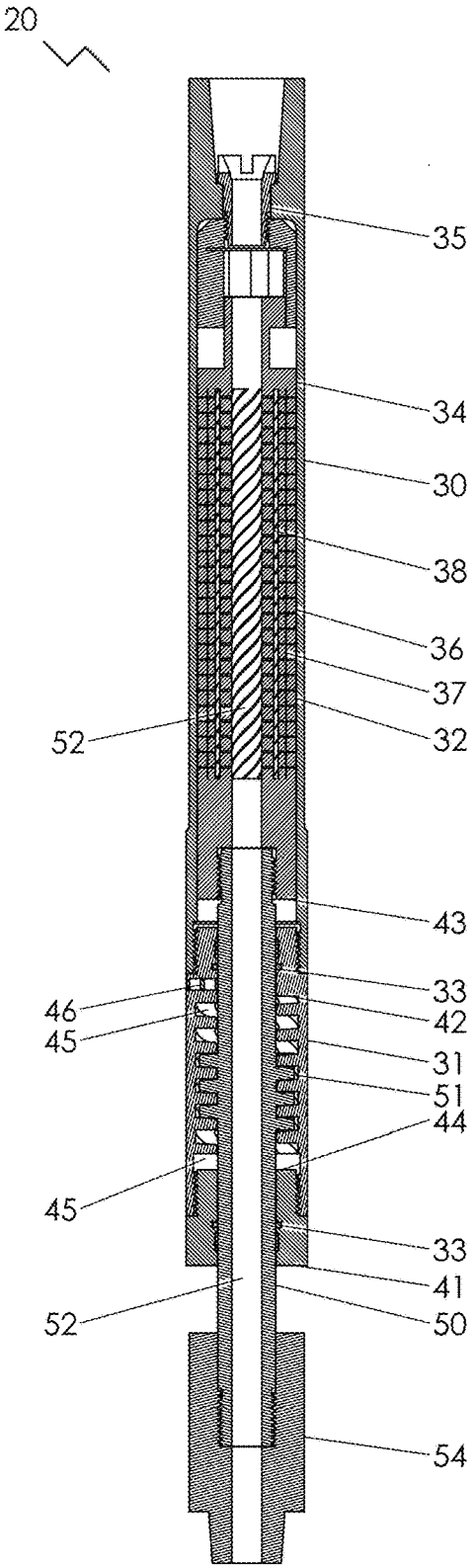
FIG. 6 is a cross-sectional view of an embodiment of a regulating device with a helical coupling and a torsional spring, with the torsional spring having plural torsional springs arranged together.

FIG. 6 illustrates an alternative embodiment of the regulating device 20, wherein the biasing device 32 may be a torsional spring. The biasing device 32 may be connected at one or both ends with a linear bearing that transmits torque but minimizes the amount of axial loading experienced by the torsional spring. A linear bearing (spline) is shown in FIG. 6 in the top connector 34. A challenge with the use of helical springs in compression or torsion may be the buckling of the spring that results in contact and friction between the spring and the housing 30 or inner support sleeve (not shown in FIG. 6). Although an inner support sleeve is not shown in FIG. 6 an inner support sleeve may be employed to support the biasing device 32 and prevent erosion of the biasing device 32. Low friction coatings on the biasing device 32 or supporting structures may be used to reduce friction. Layers of low friction wear material such as sheets of PTFE (Teflon) may be installed between the biasing device 32 and supporting structures during assembly of the tool. The torsional spring may be left-handed for typical applications where contracting forces (WOB plus torque) exceeds the extending forces (hanging weight plus pump-open forces) because torsional springs perform better when loaded in the direction that closes the spring. Right-handed wrap directions may also be employed. The biasing device 32 may comprise plural torsional springs arranged in parallel. Parallel arrangements of springs may be beneficial for any helical spring to obtain the required high forces and torques within an application with tight diameter constraints such as said regulating device 20. In FIG. 6 a number of torsion springs may be arranged both intertwined, and concentrically. There may be two or more layers of concentric torsion springs that act in parallel. Both the inner and the outer torsion spring may comprise six intertwined springs that also act in parallel. In some cases, there may be twelve springs total. It may be desirable to run more or less springs than this in varying configurations.

The outer torsional spring shown in FIG. 6 may comprise a laminate of metal on the inside with carbon fiber or other composite material outer layer(s). Composite materials may be defined as those produced from two or more constituent materials which remain distinct within the finished structure, and may be composed of fibrous material where each fiber filament has a thickness of approximately 0.1 to 100 microns with matrix/binder. Laminated materials may be defined as those produced from two or more constituent materials that are bonded together at a surface that is distinct at a level that may be visible to the naked eye. Laminated metal and composites may provide superior fatigue performance and increase the spring rate within the same total spring diameter and length as compared to the prior art metallic torsion springs. Torsion springs may function with almost pure tensile stress along the outer surface in a direction that is aligned with the helix angle of the spring. A torsion spring may be an ideal application for composites that have excellent mechanical properties in the direction of the fibers. Most (50%+) up to all (100%) of the fibers may be arranged in a direction substantially aligned with the tensile stress orientation. A portion of the fibers may be oriented at different angles to increase the shear strength and stiffness of the composite layer. The inner portion may be metal because metals have superior mechanical properties in compression and shear loading as compared to current fiber composites. Various non-cylindrical interface profiles or textures may be used to increase the bond strength between the metal and the composite, and to support the composite material, and to constrain the potential movement of the composite material in the event of partial or complete disbondment. This type of laminated metal and fiber torsion spring may be particularly well suited to applications like this regulating device where it may be highly desirable to reduce the overall length of the spring and diameter is tightly constrained. Fibers may perform better than steel in tensile fatigue and allow the spring to be designed to run at higher tensile stress. This type of configuration may be especially well suited to manufacturing by filament winding where the metallic component may be prepared with the required surface profile and finish, primed, and the fibers are wound around the metal before curing the epoxy. Fibers may be pre-pregnated with epoxy or other matrix material as are known in the art, wetted during the wrapping process, or infused. With a filament winding technique each layer may be successively pressed together by the winding tension of it and all layers above it, and it may not necessary to press the epoxy to achieve the desired density and ratio of fiber to binder. The composite may be cured after being wrapped onto the inner metallic layer. The inner metallic layer may already be formed to the shape of a spring before installing the composite, or it may be a metal tube that is wrapped with composite and later has helical slot(s) cut out of the metal and composite to form the helical spring profile. Cutting the spring profile into a tube of metal or laminate may be performed by laser but may also be performed by water jet or other machining process. In order to achieve the necessary bond strength between the metal and composite layers at the ends of the spring, the composite may be wrapped beyond the ends of the spring profile, and over this interval it may be beneficial for the metallic surface to be prepared with appropriate roughness, and geometric features to improve the bond strength. The extra length beyond the end of the spring may be between 1 and 10 pitch lengths of the spring. In FIG. 6 there may be a slight U-profile in the cross section of the spring coil that has been prepared on the metal surface in order to prevent misalignment from occurring between the metal and composite layers in the event that the bond between the composite and metal fails. Relative movement of the metal and composite layers may be restricted and spring function may not be significantly adversely affected.

Figure 6A:
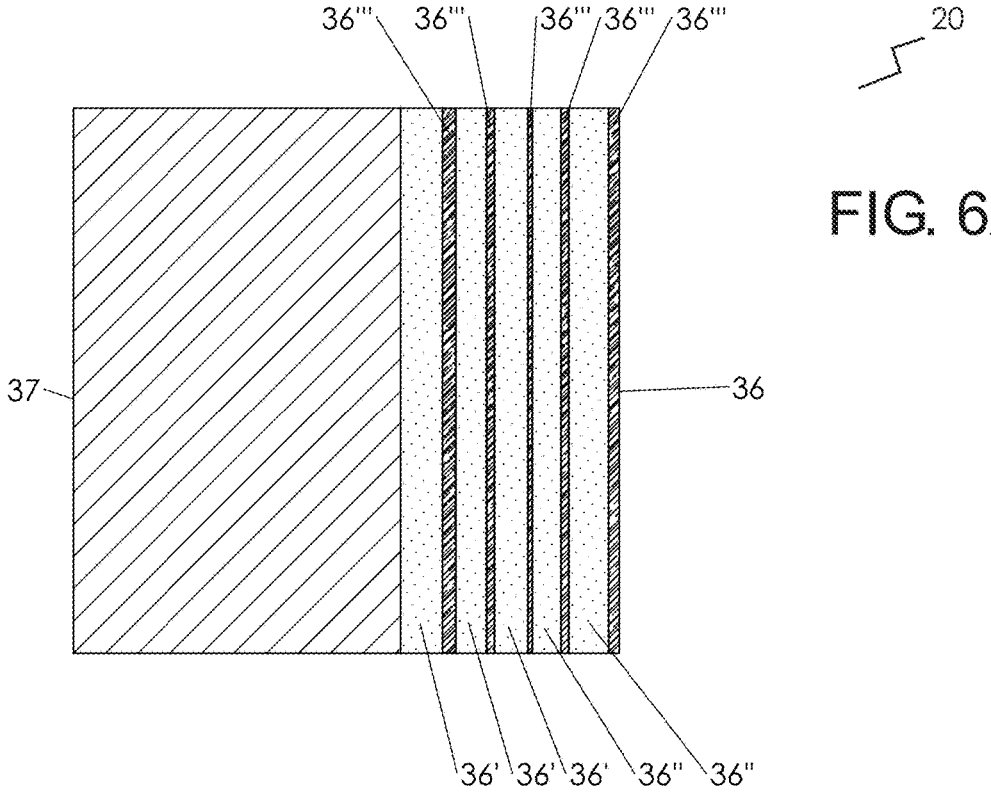
FIG. 6A is a cross-sectional close up view of a portion of a metal and composite laminated torsional spring, which can be used in a regulating device.

FIG. 6A illustrates a detailed cross section view of a metal and composite laminated torsional spring. The metallic layer 37 may be located on the inner portion of the coil and may be thicker than the composite layer. The metallic layer may be located where compression and shear stresses are highest in the torsional spring. The composite layers may comprise fiber material such as carbon fiber or fiberglass with a matrix such as epoxy, plastic, metal matrix, polymer, or other thermosetting or thermoplastic materials. The fibers may be located on the outer surface of the torsional spring. The fibers may be primarily aligned with the wrap angle of the torsional spring, which is typically aligned with the maximum tensile stress orientation when the torsional spring is loaded in the direction that causes the diameter of the spring to contract, which may be a desirable orientation for loading of a torsional spring. A portion of the layers 36''' may be wrapped in another direction, such as approximately perpendicular to the maximum tensile stress orientation to increase the shear strength of the composite layers. High modulus carbon may have a Young's modulus that is significantly higher than steel and may be used to increase the stiffness of the spring beyond the performance limits of steel in this tightly diameter-constrained application. High modulus uniaxial fibers 36' may be used closer to the center of the spring cross section, and lower modulus uniaxial fibers 36'' closer towards the outer surface of the spring cross section. The lower modulus uniaxial fibers may have a higher tensile strength than the high modulus fibers. This configuration may achieve the fatigue performance improvement mentioned earlier, but may be able to further increase the stiffness of the spring for tightly dimensionally constrained torsion spring applications like what is required for this drilling regulating device.

Figure 6B:
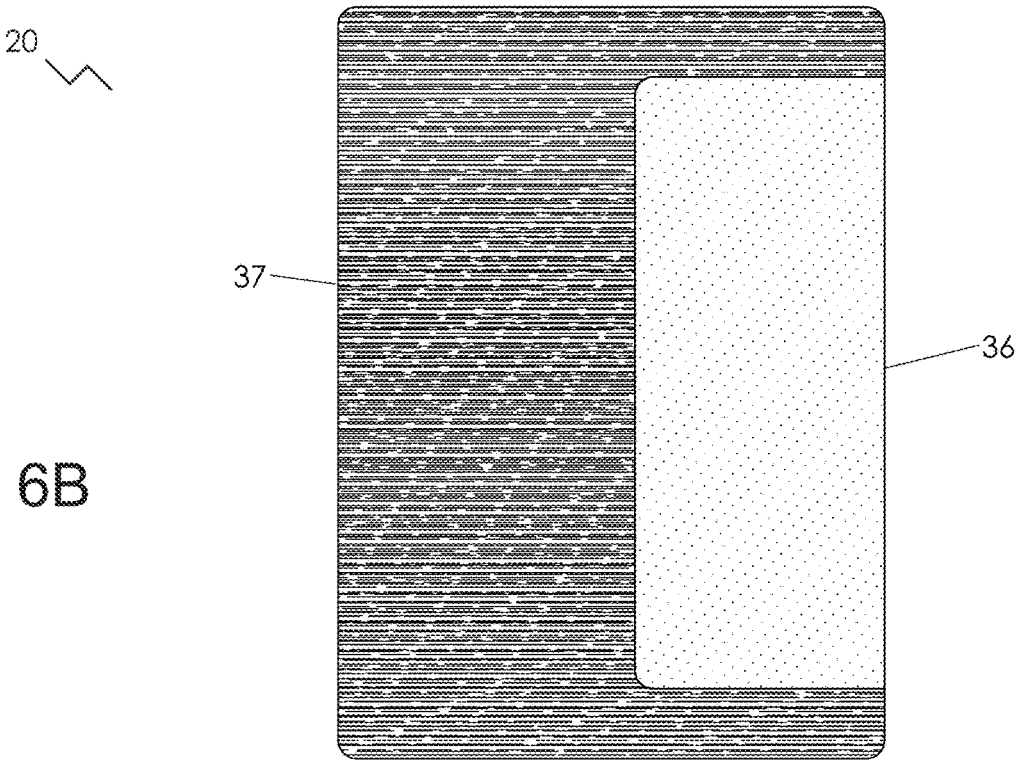
FIG. 6B is a cross-sectional close up view of a portion of another embodiment of a metal and composite laminated torsional spring, which can be used in a regulating device, wherein carbon fibers are supported by a profile of the metallic portion.

FIG. 6B illustrates a detailed cross section view of a metal and composite laminated torsional spring wherein the fibers 36 may be supported by a profile of the metallic portion. This configuration increases the available area for bonding between the composite and the metal, and supports the fibers to the extent that it is possible to run all of the fibers uniaxially in alignment with the wrap angle of the torsional spring, which is typically aligned with the maximum tensile stress orientation when the torsional spring.

Figures 7, 7A:
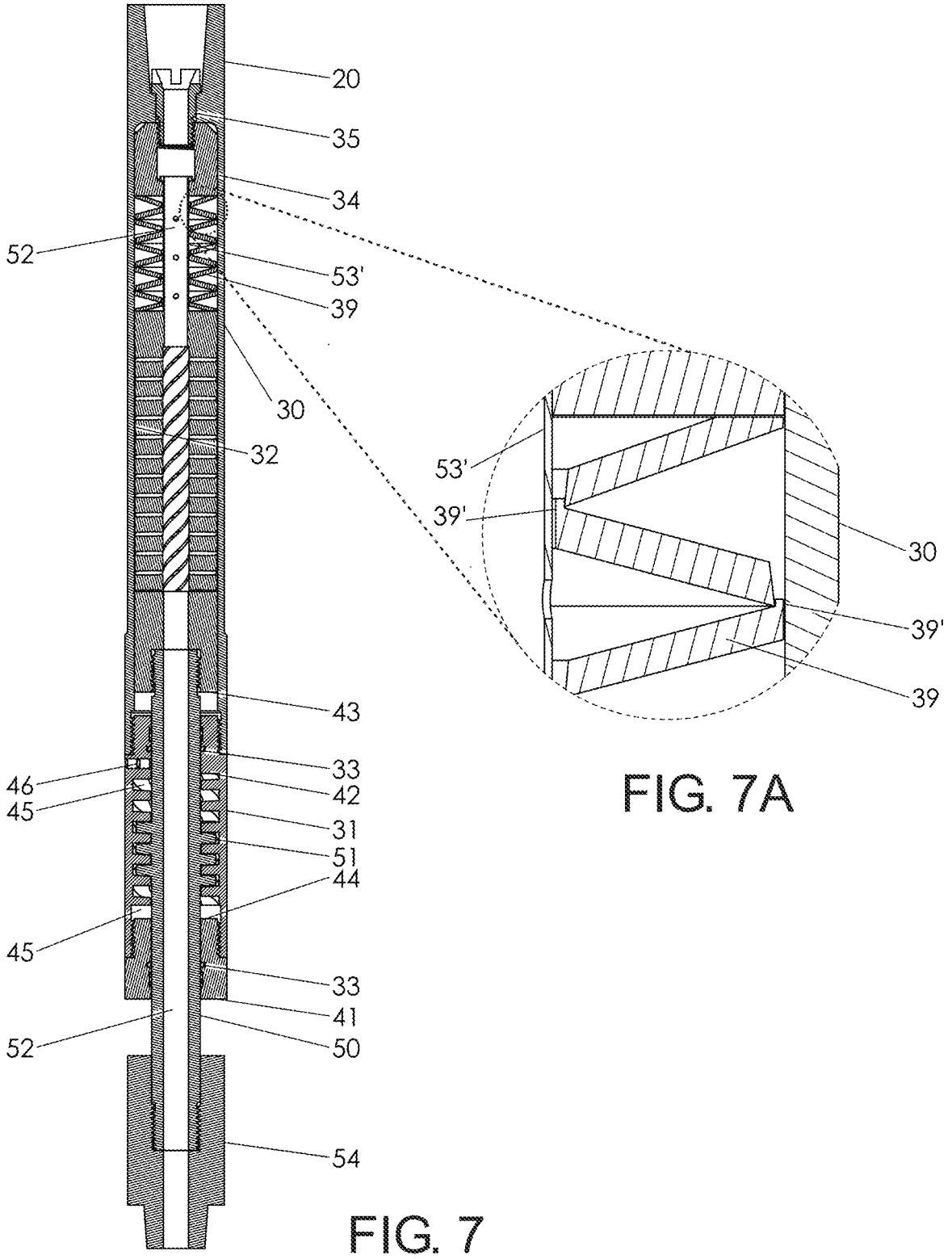
FIG. 7 is a cross-sectional view of an embodiment of a regulating device with a helical coupling and intertwined left-hand helical springs acting in series with a set of disc springs.
FIG. 7A is a detail cross section view of the section in dashed lines from FIG. 7 illustrating discs within the set of disc springs.

FIG. 7 illustrates an alternative embodiment of the regulating device 20, wherein the biasing device 32 may comprise four intertwined left-hand helical springs of rectangular cross section, being in a position between fully extended and fully contracted, such that it is free to move either direction relative to the neutral position (extension or contraction). Right-hand springs may also be used. The biasing device 32 may include a second element 39 that only functions in compression. There may be an inner sleeve 53' that performs several one or more functions. Sleeve 53' may support the second element 39. Sleeve 53' may provide a smooth fluid conduit. Sleeve 53' may carry tensile forces that bypass the second element 39 when the primary element of the biasing device 32 is extended beyond the neutral position. Alternative means to carry the tensile forces that bypass the second element 39 may be to use an external sleeve, or to connect a shoulder directly to the housing 30. The second element 39 may function only in compression and may perform one or more of several functions: to provide larger travel in the contraction direction, to reduce the spring rate in the contraction direction, or to increase the maximum force required to compress the regulating device 20 to the fully contracted position. In this embodiment the second element 39 may comprise a stack of Belleville washers, which are also known as disc springs. A Belleville washer stack may include Belleville washers that are designed to safely compress to the flat position in cyclic service, or spacers may be used as is known in the art to prevent over-compression of the discs. A variable and increasing spring rate may be achieved by utilizing a variety of discs in the stack; discs may be placed in parallel, or discs of various thickness, or discs with various free height, or roller Belleville discs (those with convex instead of flat surfaces) may be used. Stabilization of the discs to reduce buckling, misalignment between discs, and contact forces with may be achieved by utilizing discs with self-aligning grooves 39' such as those illustrated in FIG. 7A. In this embodiment the primary element (device 32) may be positioned within the female portion 30, but this configuration may be inverted and the secondary element 39 may be located over the male portion instead. It may be preferable to locate closer to the helical coupling the element of the biasing device 32, (element 39), which exhibits lower side-loading and friction.

The inner sleeve 53' may only carry a tensile load over the second element of the biasing device. While it is not shown in this drawing, an inner sleeve may extend through a portion or all of the primary element of the biasing device also. Bi-directional thrust bearings are not shown in this figure, but may be disposed at a number of locations at either end of the secondary element of the biasing device 32, within the secondary element 39, or between the primary and secondary elements of the biasing device.

FIG. 7 shows a detail view of the discs set 39 with self-aligning grooves 39'.

Figure 8:
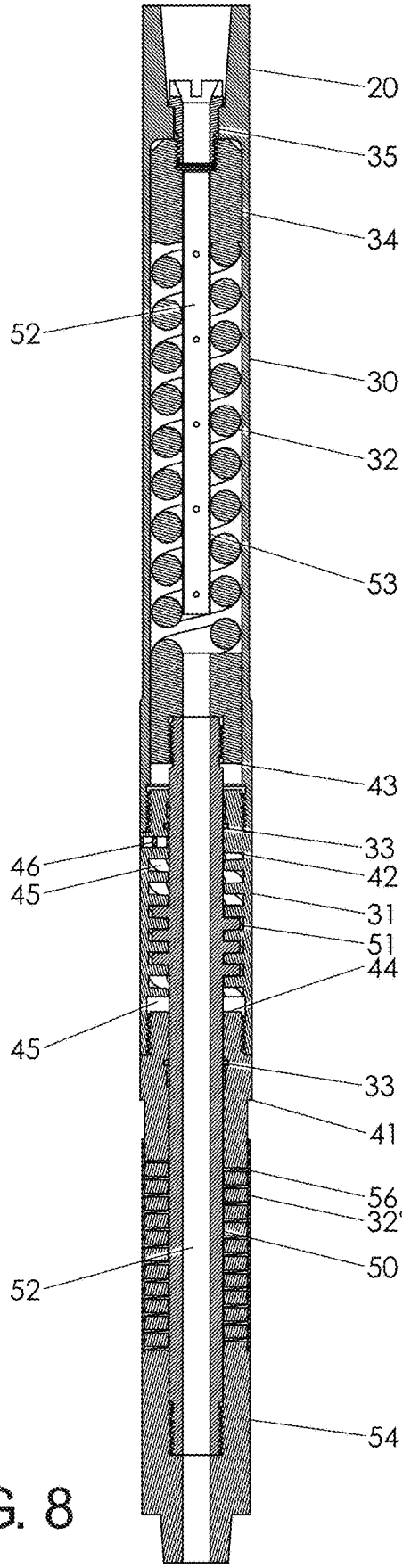
FIG. 8 is a cross-sectional view of an embodiment of a regulating device with a helical coupling and a pair of biasing devices acting in parallel.

FIG. 8 illustrates an alternative embodiment of the regulating device 20, wherein a bi-directional biasing device 32 may be located within the female portion 30 and a biasing device 32' may be located over the male portion 50. In this configuration the biasing devices act in parallel in a manner similar to multiple intertwined helical coils. In this embodiment an external protective sleeve 56 may be disposed around the exterior of the biasing device 32' that is over the male portion 50. The outer sleeve protects the biasing device 32' from wear and contain the pieces if the biasing device 32' breaks. The biasing device 32' may be a single helical spring with a rectangular cross section over the male portion 50. The biasing device 32 may be a single helical spring with a circular cross section connected to the male portion of the helical coupling. Both biasing devices in this embodiment may be connected directly without bearings or splines and accommodate both axial and rotational movement as defined by the helical coupling while creating reactive axial and torsional forces. Alternatively, bi-directional thrust bearings or splines may be employed at the ends of one or both biasing devices. Both biasing devices may work in parallel on the helical coupling, and the forces may be shared between the two biasing devices which enables each biasing device to be smaller, easier manufacture, more reliable in service, provide a larger total amount of stroke or rotation, and reduce binding and friction and may provide a more responsive device.

Figure 9:
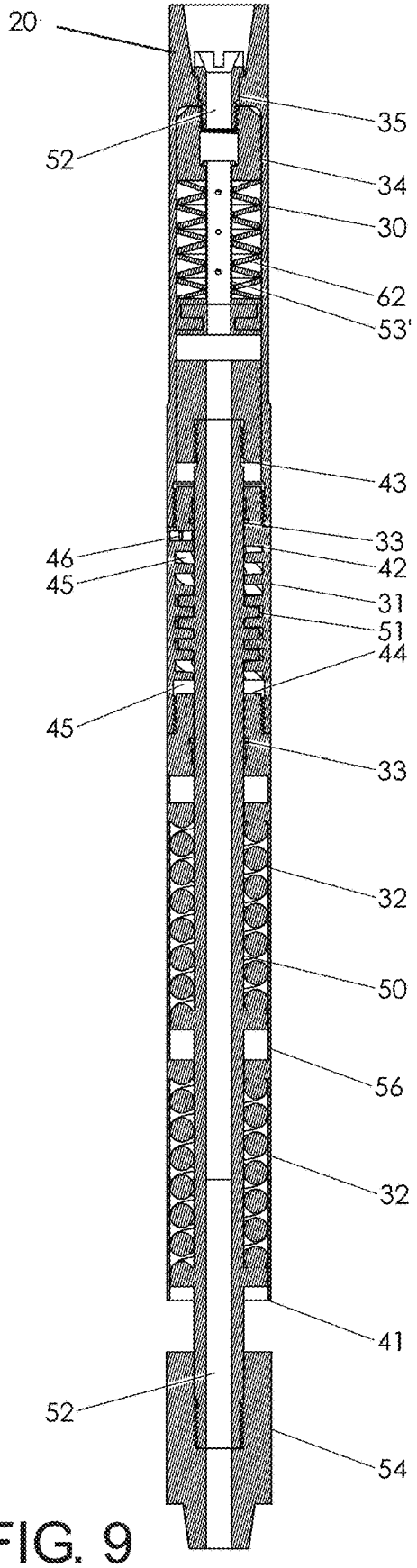
FIG. 9 is a cross-sectional view of an embodiment of a regulating device with a helical coupling and helical springs and a compression spring that is acting in parallel for a portion of the stroke.

FIG. 9 illustrates an alternative embodiment of the regulating device 20, wherein the biasing device 32 may be a helical spring that is configured to act bi-directionally. The biasing device 32 may comprise multiple springs located over the male portion 50, that are connected between the male portion 50 and an external sleeve 56 wherein the external sleeve 56 is connected to female portion 30. A biasing device 32 may be rigidly connected at both ends to transmit torque and axial load, or may be connected with a spline or ball spline at one or both ends to transmit only torque, or may be connected with a bi-directional bearing at one or both ends to transmit only axial loads. A second biasing device 62 comprised of a compression spring such as a disc spring, as is known, may be located within the female portion 30. Alternatively, the second biasing device may be located between the external sleeve 56 and the tool joint 54. Alternatively, the biasing device 32 may be located in the female portion 30, or the biasing device 32 may be located in the female portion 30 and over the male portion 50. The second biasing device may be configured such that it is not engaged to transmit forces between the female portion 30 and the male portion 50 while the device is at the neutral position. The second biasing device may function to increase the spring rate, and the sprung load capacity of the regulating device in the compressive direction. When the regulating device contracts from the neutral position, initially the load may be resisted only by the first biasing device 32, but upon further compression the male portion 50 contacts the thrust bearing of the second biasing device 62 and compresses the second biasing device 62. The second biasing device may have a constant or variable spring curve.

Figure 10:
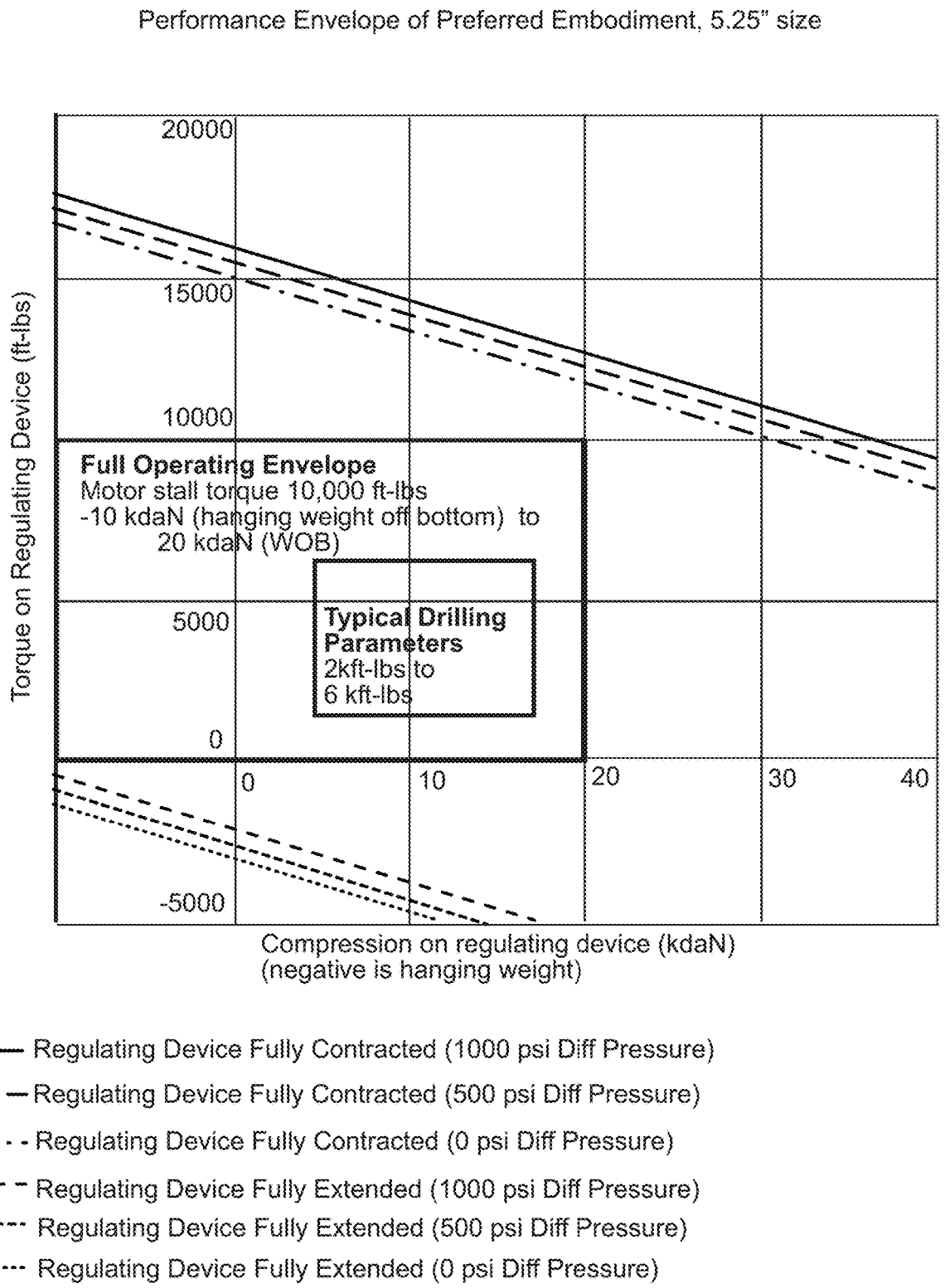
FIG. 10 is a chart that details a predicted performance envelope for an embodiment of a regulating device according to the disclosure herein.

FIG. 10 illustrates a predicted performance envelope for an embodiment in a 5.25" outer diameter (OD) size of regulating device. Hanging weight of the BHA beneath the regulating device results in a negative compressive force on the x axis. As weight on bit and torque are applied to the BHA through the drilling process, and this results in a positive compressive force on the x axis and positive torque on the y axis. Drilling conditions may impart any combination of torque (right hand=positive, or left hand=negative during severe stick-slip conditions or below a reamer), and axial force (compressive=positive, tensile=negative). Axial force may be calculated as Weight on Bit WOB−pump open force−buoyed hanging weight. The 'Performance Envelope' represents the range of forces the regulating device can withstand prior to reaching a position limiting shoulder in either contraction or extension. Typical drilling parameters used when on bottom under normal drilling situations are shown to be well within the middle of the performance envelope labeled 'Typical Drilling Parameters'. The 'Full Operating Envelope' may be a much larger range of conditions which may be expected to be experienced by the tool during common drilling operations which includes tripping, circulating off bottom, and drilling through formation transitions and stringers. The performance envelope of the device may be designed to encompass the Full Operating Envelope, which requires a bi-directional biasing device.

Figure 11:
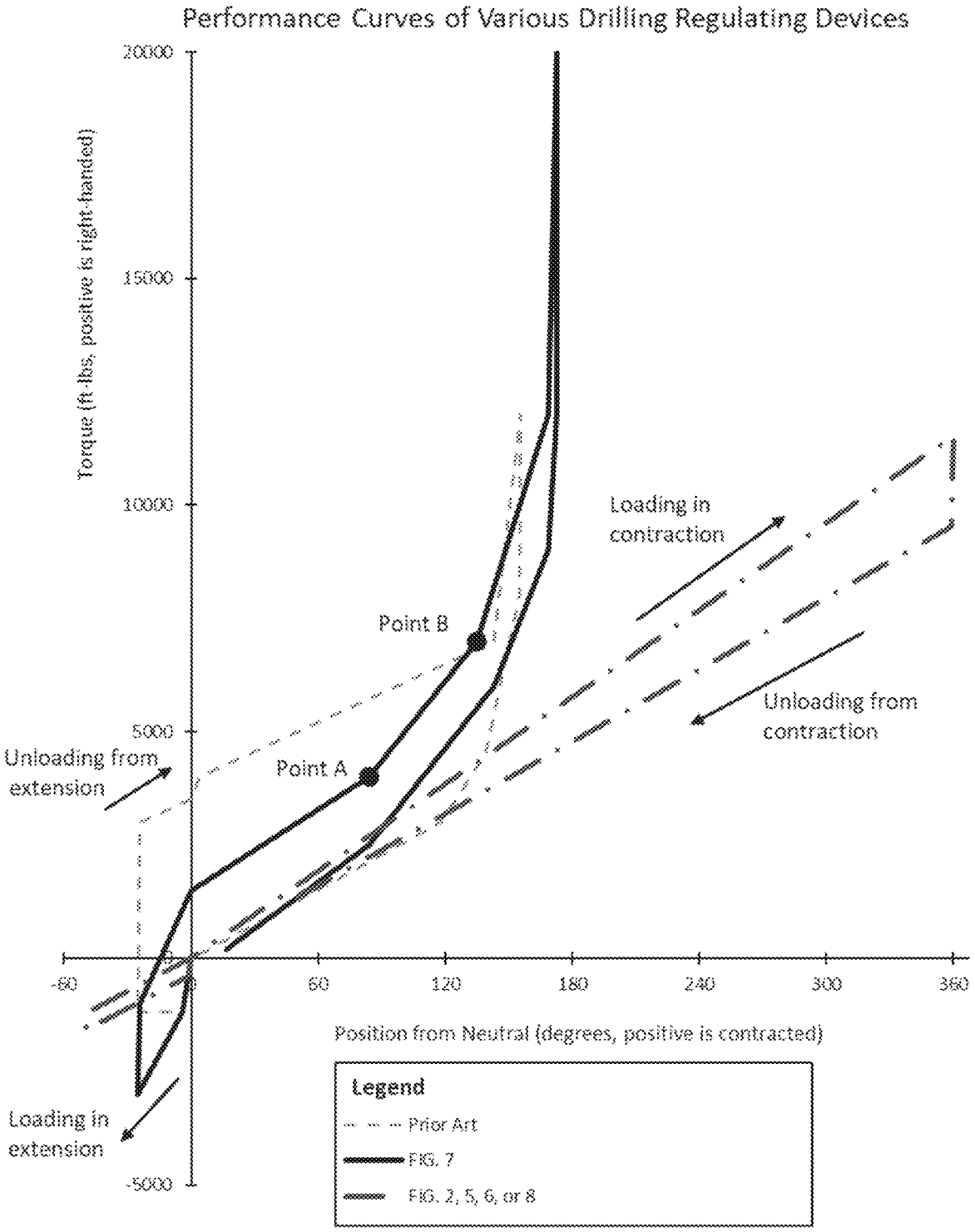
FIG. 11 is a chart that details a predicted performance curve for embodiments of a regulating device according to the disclosure herein.

FIG. 11 illustrates the performance curves for the regulating device in torsion. The devices are tested in torsion as this may be the primary direction of shock and vibration created by PDC drilling bits, reamers, and other modern drilling assembly components such as stabilizers and rotary steerable contact pads. In the field of spring and suspension design, hysteresis is the term used to describe the comparison of the force/torsion when loading the shock versus the return force/torsion when unloading the shock. Friction effects result in a difference between the loading and unloading curves and the difference is commonly referred to as hysteresis. Hysteresis is expected to be high for known designs such as that of U.S. Pat. No. 10,533,376 with opposing or preloaded springs which place the neutral position between the fully contracted and fully extended positions, and can be observed in the wide spread between the simulated loading and unloading curves. The simulated spring curves and hysteresis are shown for two embodiments of the regulating device corresponding approximately to designs represented by FIG. 7 and FIG. 2, FIG. 5, FIG. 6, or FIG. 8 with optimized biasing device and helical coupling designs. Again, it must be noted that the scale and length of patent figures wherein may not be accurately represented in the figures. The figures generally illustrate reduced lengths and number of elements/coils for the biasing device(s) and similarly for the helical coupling in order to keep the aspect ratio of the drawings manageable so that key features can be clearly seen. Referring to the performance curve of the FIG. 7 embodiment multiple spring rates can be observed. In extension, only the first biasing element is acting in tension.

In contraction, in the first segment between the neutral position and Point A both the first and second elements of the biasing device are being compressed. Between Point A and Point B only the second element of the biasing device is being compressed. Beyond Point B the spring rate continues to increase as the more flexible discs used within the stack becomes flattened or shouldered on spacer rings and only the stiffer discs remain to be compressed. The variable spring curve of this embodiment is similar to the prior art; however, the advantage is that there may be a reduction in the hysteresis such that the regulating device of FIG. 7 can provide a restoring force that is closer to the loading force as compared to the prior art. Referring to the curve representing FIG. 2, 5, 6, 8 there are three further advantages that may be observed in the performance curves. First, the hysteresis is further reduced. Second, the spring rate is approximately constant which has the benefit of providing a lower spring rate in the expected drilling parameters range of 2,000 to 6,000 ft-lbs of torque. Third, the helix angle is reduced which may enable more rotational displacement while maintaining a reasonable overall tool length, and overall a more responsive tool to input torsional shocks and vibration.

Figures 12A, 12B, 12C:
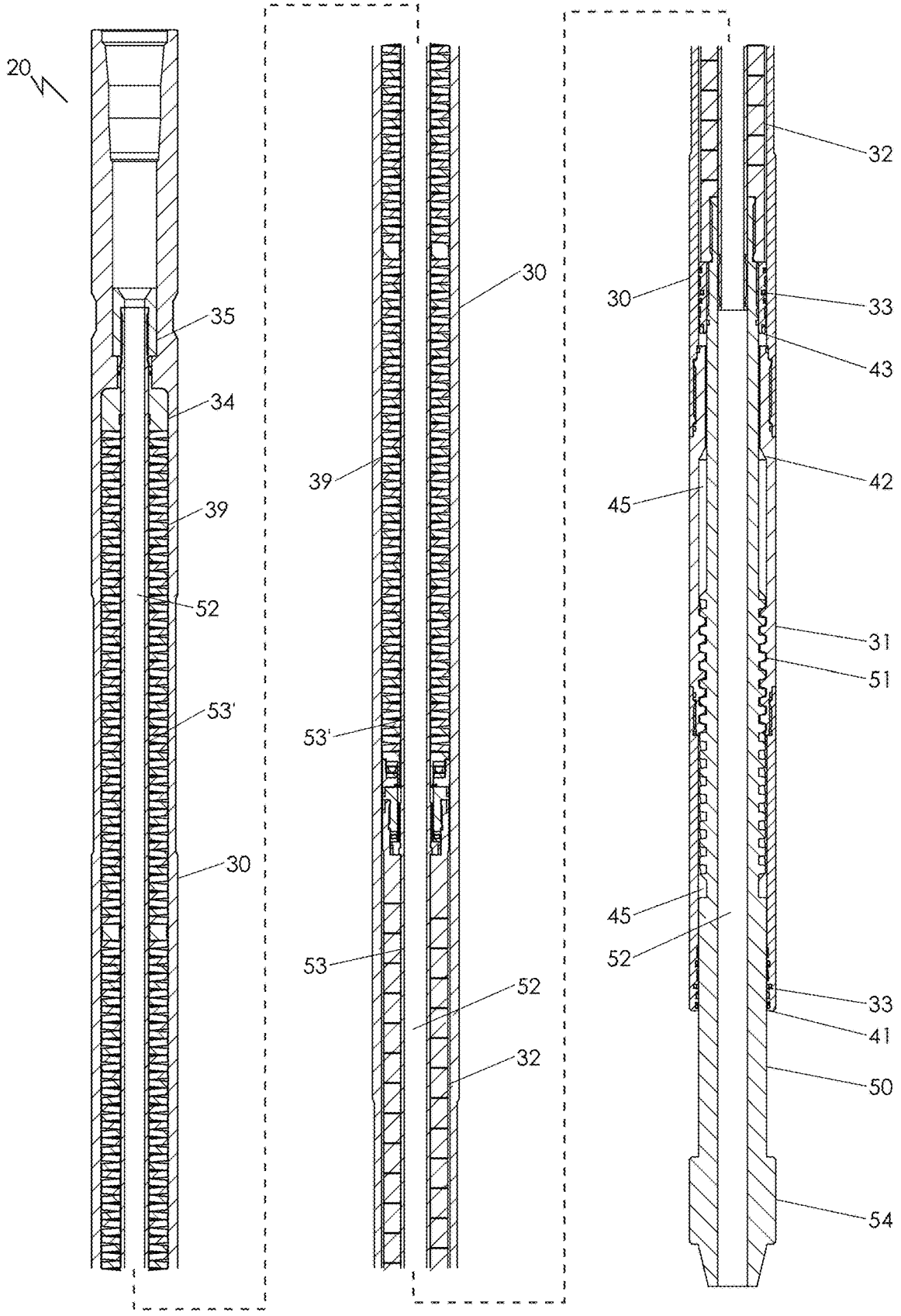
FIGS. 12A-C collectively make up a cross-sectional view of a full-length proportioned device with a configuration of major elements generally similar to that of FIG. 7.

FIGS. 12A-C collectively show a cross section view of a full-length proportioned device with a configuration of major elements and function generally similar to that of FIG. 7. Several practical differences may be noted in FIGS. 12A-C which include: greater length and thickness of the biasing device primary element 32 and of the secondary element 39; greater length and steeper lead angle in the helical coupling; the helical guide on the male portion of the helical coupling 51 is longer than the helical guide on the female portion of the helical coupling 31; the lower tooljoint 54 is integral (same piece) as the male portion 50; both the upper and lower seals 33 are positioned at a diameter larger than the helix wherein the upper seals 33 are now in male grooves with a female countersurface on the housing 30, the extension shoulder at position 43 is the only extension shoulder; a bi-directional roller thrust bearing assembly is located between primary element 32 and of the secondary element 39 of the biasing device; and the top assembly screw 35 is a nut (female threads); the inner sleeve functions to support the primary element of the biasing device 32 and provide a smooth fluid conduit at the lower portion of the sleeve 53 while also in the top portion of the sleeve 53' to provide a tensile stop for the secondary element of the biasing device 39; when the secondary element of the biasing device 39 is compressed, the sleeve 53 and 53' and the top assembly nut 35 move axially relative to housing 30. The configuration of various connections and seals may be favorable for manufacturing, assembly, and strength.

Some features are mentioned in mutually different dependent claims and some combination of these features may be used with advantage.

Table of Parts:

1 Drill string
2 Upper drill-string portion
2' Lower drill-string portion
3 "Top drive"
4 Drilling rig
5 Drill bit
6 Drilling motor
7 Wellbore
20 Regulating device
30 Female portion which is referred to as a housing -continued Table of Parts:

31 A helical guide on the female portion of the helical coupling
32 Biasing Device
33 Seals, scrapers, and radial bushing to control lateral movement between the male and female portions and to seal lubricant within the helical coupling
34 Top connector which may include bi-directional linear bearing or bi-directional rotational bearing
35 Top assembly screw
36 Layer of composite material in laminated torsional spring
36' Layer of high modulus uniaxial fiber oriented in the tensile stress orientation
36" Layer of lower modulus higher tensile strength uniaxial fiber oriented in the tensile stress orientation
36"' Layer of fiber that is misaligned with the tensile stress orientation
37 Layer of metallic material in laminated torsional spring
38 Inner torsional spring
39 Second element of the biasing device that functions only in compression connected in series with the primary element
39' disc self aligning grooves
41 Contracted shoulder
42 Alternate contracted shoulder
43 Extension shoulder
44 Alternate extension shoulder
45 Fluid chamber between seals for damping and lubrication of the helical coupling
46 Fluid chamber pressure balancing device
47 Lower shoulder in the housing for biasing device acting in extension
47' Upper shoulder for biasing device when acting in extension - at top of inner tension sleeve (53')
48 Lower shoulder for biasing device when acting in compression at male portion (50)
48' Upper shoulder for biasing device when acting in compression - at housing (30)
50 Male portion of the regulating device
51 Helical guide on the male portion of the helical coupling
52 Fluid channel for the supply of drilling fluid to the drill bit
53 Inner sleeve to support biasing device and provide a smooth fluid conduit
53' Inner sleeve to support biasing device, provide a smooth fluid conduit, and provide a tensile stop
54 Tooljoint to facilitate handling in the field and the primary shoulder for contraction
55 Bi-directional radial bearing
56 External protective sleeve for biasing device
62 Second Biasing Device that functions only in compression connected in parallel with the bi-directional biasing device In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The invention claimed is:

1. A downhole regulating device for use in a drill string, the downhole regulating device comprising:

a helical coupling between a lower portion and an upper portion of the downhole regulating device and structured to allow relative axial and rotational movement between the lower portion and the upper portion; and a bi-directional biasing device that resists movement between the lower portion and the upper portion in both axial extension and contraction directions and is arranged such that a neutral position of the bi-directional biasing device is between fully extended and fully contracted positions of the helical coupling;

wherein the bi-directional biasing device is structured to resist movement between the lower portion and the upper portion, by shortening under compression and elongating under tension, when moving away from the neutral position; and wherein the bi-directional biasing device is axially fixed to both the lower portion and the upper portion using one or more bi-directional thrust bearings.

2. The downhole regulating device of claim 1, wherein the bi-directional biasing device comprises a helical spring that functions in torsion, compression, and tension.

3. The downhole regulating device of claim 1, wherein the bi-directional biasing device comprises a plurality of helical springs that act in parallel or series.

4. The downhole regulating device of claim 1, wherein the bi-directional biasing device defines a central fluid passage.

5. The downhole regulating device of claim 3, wherein the bi-directional biasing device comprises one or multiple intertwined helical springs whose helical spring coils shoulder on adjacent helical spring coils in the fully contracted position.

6. The downhole regulating device of claim 2, wherein the helical coupling has a right-hand thread and the bi-directional biasing device comprises a plurality of helical springs, with a left-hand coil direction, that are rigidly connected to the lower portion and rigidly connected to the upper portion and function in combined torsion, compression, and tension.

7. The downhole regulating device of claim 1, wherein:

the bi-directional biasing device comprises a first element and a second element;

the second element comprises a compressive spring;

the second element modifies a spring rate or increases a stroke length in the contraction direction of the bi-directional biasing device; and the first and second elements of the bi-directional biasing device work together in the same direction to extend the downhole regulating device between a contracted position and the neutral position.

8. The downhole regulating device of claim 7 in which the second element comprises a stack of disc springs.

9. The downhole regulating device of claim 7 in which the bi-directional thrust bearing is located between the first element and the second element of the biasing device.

10. The downhole regulating device of claim 1, wherein the bi-directional biasing device comprises a laminate of metal on an inside portion of the bi-directional biasing device with one or more layers of a composite material on an outside of the bi-directional biasing device.

11. The downhole regulating device of claim 1, wherein shoulders are employed to limit a stroke of the bi-directional biasing device in both extension and contraction.

12. The downhole regulating device of claim 1, wherein the helical coupling defines a helix angle of between 10 and 70 degrees.

13. The downhole regulating device of claim 1 further comprising a second biasing device configured with a compression spring that it is not in a load path of the bi-directional biasing device and works in parallel, wherein the second biasing device is not acting to extend the regulating device while the regulating device is at the neutral point.

14. A method of operating a drill string, which comprises a drill bit, a downhole motor, and the downhole regulating device of claim 1, in which the method comprises:

operating the drill bit in a well to drill, ream, or mill the well.

15. The method of claim 14, wherein the downhole regulating device is arranged below a reamer, and operating comprises operating the drill bit to drill and ream the well.

16. The method of claim 14, wherein the downhole regulating device is arranged above a reamer, and operating comprises operating the drill bit to drill and ream the well.

17. The downhole regulating device of claim 1 further comprising:

a housing that contains the bi-directional biasing device and is fluid-filled; and a drilling fluid conduit in the housing isolated from the bi-directional biasing device.

18. A method comprising:

operating a drill string in a well to drill, ream, or mill; and in which, during operation, a downhole regulating device in the drill string acts to relatively axially extend and retract an upper portion, and a lower portion, of the downhole regulating device corresponding to an angular position of the upper portion relative to the lower portion, in which a helical coupling of the downhole regulating device is structured to permit the axial extension and retraction between the lower portion and the upper portion, while a bi-directional biasing device of the downhole regulating device resists movement between the lower portion and the upper portion in both axial extension and contraction directions, in which the bi-directional biasing device is arranged such that a neutral position of the bi-directional biasing device is between fully extended and fully contracted positions of the downhole regulating device, and the bi-directional biasing device is structured to resist movement between the lower portion and the upper portion, by shortening under compression and elongating under tension, when moving away from the neutral position, and wherein the bi-directional biasing device is axially fixed to both the lower portion and the upper portion using one or more bi-directional thrust bearings.

19. A downhole regulating device for use in a drill string, the downhole regulating device comprising:

a helical coupling between a lower portion and an upper portion of the downhole regulating device and structured to allow relative axial and rotational movement between the lower portion and the upper portion; and a bi-directional biasing device that resists movement between the lower portion and the upper portion in both axial extension and contraction directions and is arranged such that a neutral position of the bi-directional biasing device is between fully extended and fully contracted positions of the helical coupling;

wherein the bi-directional biasing device is structured to resist movement between the lower portion and the upper portion, by shortening under compression and elongating under tension, when moving away from the neutral position; and wherein the bi-directional biasing device comprises a plurality of helical springs that act in parallel or series.

20. A downhole regulating device for use in a drill string, the downhole regulating device comprising:

a helical coupling between a lower portion and an upper portion of the downhole regulating device and structured to allow relative axial and rotational movement between the lower portion and the upper portion; and a bi-directional biasing device that resists movement between the lower portion and the upper portion in both axial extension and contraction directions and is arranged such that a neutral position of the bi-directional biasing device is between fully extended and fully contracted positions of the helical coupling;

wherein the bi-directional biasing device is structured to resist movement between the lower portion and the upper portion, by shortening under compression and elongating under tension, when moving away from the neutral position;

wherein the bi-directional biasing device comprises a helical spring that functions in torsion, compression, and tension; and wherein the helical coupling has a right-hand thread and the bi-directional biasing device comprises a plurality of helical springs, with a left-hand coil direction, that are rigidly connected to the lower portion and rigidly connected to the upper portion and function in combined torsion, compression, and tension.

21. A downhole regulating device for use in a drill string, the downhole regulating device comprising:

a helical coupling between a lower portion and an upper portion of the downhole regulating device and structured to allow relative axial and rotational movement between the lower portion and the upper portion; and a bi-directional biasing device that resists movement between the lower portion and the upper portion in both axial extension and contraction directions and is arranged such that a neutral position of the bi-directional biasing device is between fully extended and fully contracted positions of the helical coupling;

wherein the bi-directional biasing device is structured to resist movement between the lower portion and the upper portion, by shortening under compression and elongating under tension, when moving away from the neutral position; and wherein:

the bi-directional biasing device comprises a first biasing element and a second biasing element;

the second biasing element comprises a compressive spring;

the second biasing element modifies a spring rate or increases a stroke length in the contraction direction of the bi-directional biasing device; and the first and second biasing elements of the bi-directional biasing device work together in the same direction to extend the downhole regulating device between a contracted position and the neutral position.

22. The downhole regulating device of claim 21 in which the second biasing element comprises a stack of disc springs.

23. The downhole regulating device of claim 21 in which a bi-directional thrust bearing is located between the first biasing element and the second biasing element of the biasing device.

24. A downhole regulating device for use in a drill string, the downhole regulating device comprising:

a helical coupling between a lower portion and an upper portion of the downhole regulating device and structured to allow relative axial and rotational movement between the lower portion and the upper portion; and a bi-directional biasing device that resists movement between the lower portion and the upper portion in both axial extension and contraction directions and is arranged such that a neutral position of the bi-directional biasing device is between fully extended and fully contracted positions of the helical coupling;

wherein the bi-directional biasing device is structured to resist movement between the lower portion and the upper portion, by shortening under compression and elongating under tension, when moving away from the neutral position; and further comprising a second biasing device comprising a compression spring that is not in a load path of the bi-directional biasing device and works in parallel with the bi-directional biasing device, wherein the second biasing device is not acting to extend the regulating device while the regulating device is at the neutral point.

* * * * *